United States Patent [19]

Kimpara

[11] Patent Number: 5,001,959

[45] Date of Patent: Mar. 26, 1991

[54] ELECTRONIC MUSICAL INSTRUMENT

[75] Inventor: Mamoru Kimpara, Hamamatsu, Japan

[73] Assignee: Yamaha Corporation, Hamamatsu, Japan

[21] Appl. No.: 291,147

[22] Filed: Dec. 28, 1988

[30] Foreign Application Priority Data

| | | | |
|---|---|---|---|
| Dec. 29, 1987 | [JP] | Japan | 62-332271 |
| Dec. 29, 1987 | [JP] | Japan | 62-332272 |
| Dec. 29, 1987 | [JP] | Japan | 62-332273 |
| Mar. 31, 1988 | [JP] | Japan | 63-79927 |

[51] Int. Cl.[5] ..... G10H 7/00; G10H 1/40; G10H 1/34

[52] U.S. Cl. ..... 84/635; 84/615; 84/636; 84/644; 84/DIG. 12

[58] Field of Search ..... 84/DIG. 12, 1.03, 1.11, 84/1.12, 1.17, 1.01, 1.19, 1.28, 610–612, 622, 626, 627, 633–637, 644

[56] References Cited

U.S. PATENT DOCUMENTS

| | | | |
|---|---|---|---|
| 4,467,690 | 8/1984 | Nishimoto | 84/DIG. 12 |
| 4,478,123 | 10/1984 | Hoshii | 84/1.03 |
| 4,481,853 | 11/1984 | Ishikawa | 84/DIG. 12 |
| 4,554,854 | 11/1985 | Kato | 84/1.03 |
| 4,628,788 | 12/1986 | Shibukawa | 84/DIG. 12 |
| 4,672,876 | 6/1987 | Sugiyama et al. | 84/635 |
| 4,685,370 | 8/1987 | Okuda et al. | 84/DIG. 12 |
| 4,713,996 | 12/1987 | Oguri | 84/DIG. 12 |
| 4,723,467 | 2/1988 | Kato | 84/DIG. 12 |
| 4,748,885 | 6/1988 | Sato | 84/DIG. 12 |
| 4,757,736 | 7/1988 | Tajima | 84/DIG. 12 |

FOREIGN PATENT DOCUMENTS

| | | | |
|---|---|---|---|
| 2547632 | 4/1977 | Fed. Rep. of Germany | 84/DIG. 12 |

*Primary Examiner*—Fred L. Braun
*Assistant Examiner*—Matthew S. Smith
*Attorney, Agent, or Firm*—Spensley, Horn, Jubas & Lubitz

[57] ABSTRACT

An electronic musical instrument includes a performance operating member, a sound source unit, an assignment information memory, a control information register and a determining unit. The sound source unit generates a plurality of rhythm tones. The assignment information memory stores assignment information representing a type of rhythm tone assigned to the performance operating member. The control information register registers the assignment information in the assignment information memory in response to a manual operation of a performer. The determining unit determines a rhythm tone to be assigned to the performance operating member in accordance with a number of operation times of the performance operating member in relation to an operation of the control information register.

26 Claims, 20 Drawing Sheets

ELECTRONIC MUSICAL INSTRUMENT

BACKGROUND OF THE INVENTION

The present invention relates to an electronic musical instrument and, more particularly, to an electronic musical instrument in which a plurality of types of rhythm sound sources can be operated by a minimum number of operating members.

In some conventional electronic musical instruments of this type, when one of the keys on a keyboard is depressed, one of a plurality of rhythm sound sources is assigned to the depressed key (U.S. Pat. No. 4,672,876).

In this conventional arrangement, an arbitrary rhythm sound source can be assigned to each of the keys on a keyboard originally used for generating main musical tones consisting of a melody and a chord. Therefore, as compared with an arrangement in which a specific selecting operating member is individually assigned to each rhythm sound source, the overall arrangement can be simplified.

If keys are assigned as performance operating members to rhythm sound sources in a one-to-one relation, however, a large number of keys are required for designating the type of rhythm sound source, resulting in a still complex overall arrangement. In addition, a performer must execute a cumbersome operation for selecting one or a plurality of arbitrarily assigned rhythm sound sources upon a performance. This operation cannot be easily done during a performance even if the performer wants to change the rhythm sound source.

In some conventional automatic rhythm apparatus of this type, a rhythm/tone color designating button (commonly referred to as a "white button") to which no specific function is assigned is used as an operating means for changing a rhythm performance state (Japanese Patent Laid-Open (Kokai) Nos. 62-187893 and 61-176991).

This automatic rhythm apparatus, however, must switch a variety of performance states such as start and stop of a rhythm performance, switching between rhythm sound sources, switching between rhythm patterns, and insertion of fill-in. Therefore, a large number of operating members are required if they are assigned to the respective performance states in a one-to-one relation. As a result, switching labors of a performer are increased.

In the conventional automatic rhythm apparatus of this type, in order to adjust a volume of a rhythm performance tone, a rhythm volume knob is arranged on an operation panel in addition to other operating members and used to adjust the volume during a rhythm performance.

In this case, if a volume, a pattern or the like can be changed as needed during a rhythm performance so as not to allow a rhythm performance tone to be monotonous, e.g., if the rhythm tone can be controlled to be a hot or cool impression as needed during a performance, the above automatic rhythm apparatus can be functionally advanced.

In the above conventional arrangement, however, a performer usually operates performance operating members such as keys or pads during a rhythm performance. Therefore, it is practically impossible to adjust the volume or the like of a rhythm tone during a performance.

As disclosed in Japanese Patent Laid-Open (Kokai) No. 61-282896, a conventional apparatus of this type comprises an assigning means for assigning an arbitrary one of a larger number of types of tones than a plurality of operating members to each operating member, and a tone generation control means for supplying data representing a tone assigned to an operated operating member to a tone signal generating means in response to an operation of each of the plurality of operating members, thereby controlling generation of the tone executed by the tone signal generating means. In this manner, after the assigning means assigns an arbitrary tone to each operating member, the assigned tone is generated upon operation of the operating member, thereby generating a larger number of tones by a smaller number of operating members.

In the above conventional apparatus, however, it is difficult to change assignment of a tone to an operating member during a performance. Therefore, only tone signals in number equal to that of operating members can be generated in one piece of music.

SUMMARY OF THE INVENTION

It is, therefore, a principal object of the present invention to provide an electronic musical instrument capable of generating a large number of rhythm tones by a relatively small number of operating members and controlling generation of the tones.

It is another object of the present invention to provide an electronic musical instrument capable of easily changing a large number of rhythm sound sources if necessary by using operating members in a sufficiently small number to be easily selected/operated in practical use.

It is still another object of the present invention to provide an electronic musical instrument in which rhythm performance state information corresponding to a variety of rhythm performance states can be inputted with a simple arrangement.

It is still another object of the present invention to provide an electronic musical instrument in which a rhythm tone can be changed while performance operating members are operated, thereby improving a performance effect of an automatic rhythm tone in practical use.

In order to achieve the above objects of the present invention, there is provided an electronic musical instrument comprising a performance operating member, a sound source unit for generating a plurality of rhythm tones, an assignment information memory means for storing assignment information representing a type of rhythm tone assigned to the performance operating member, a control information registering means for registering the assignment information in said assignment information memory means in response to a manual operation of a performer, and a determining means for determining a rhythm tone to be assigned to the performance operating member in accordance with a number of operation times of the performance operating member in relation to an operation of the control information registering means.

DETAILED DESCRIPTION OF THE PREFERRED EMBODIMENTS

An embodiment of the present invention will be described in detail below with reference to the accompanying drawings.

[1] First Embodiment

(1) Arrangement of First Embodiment

Figure 1:
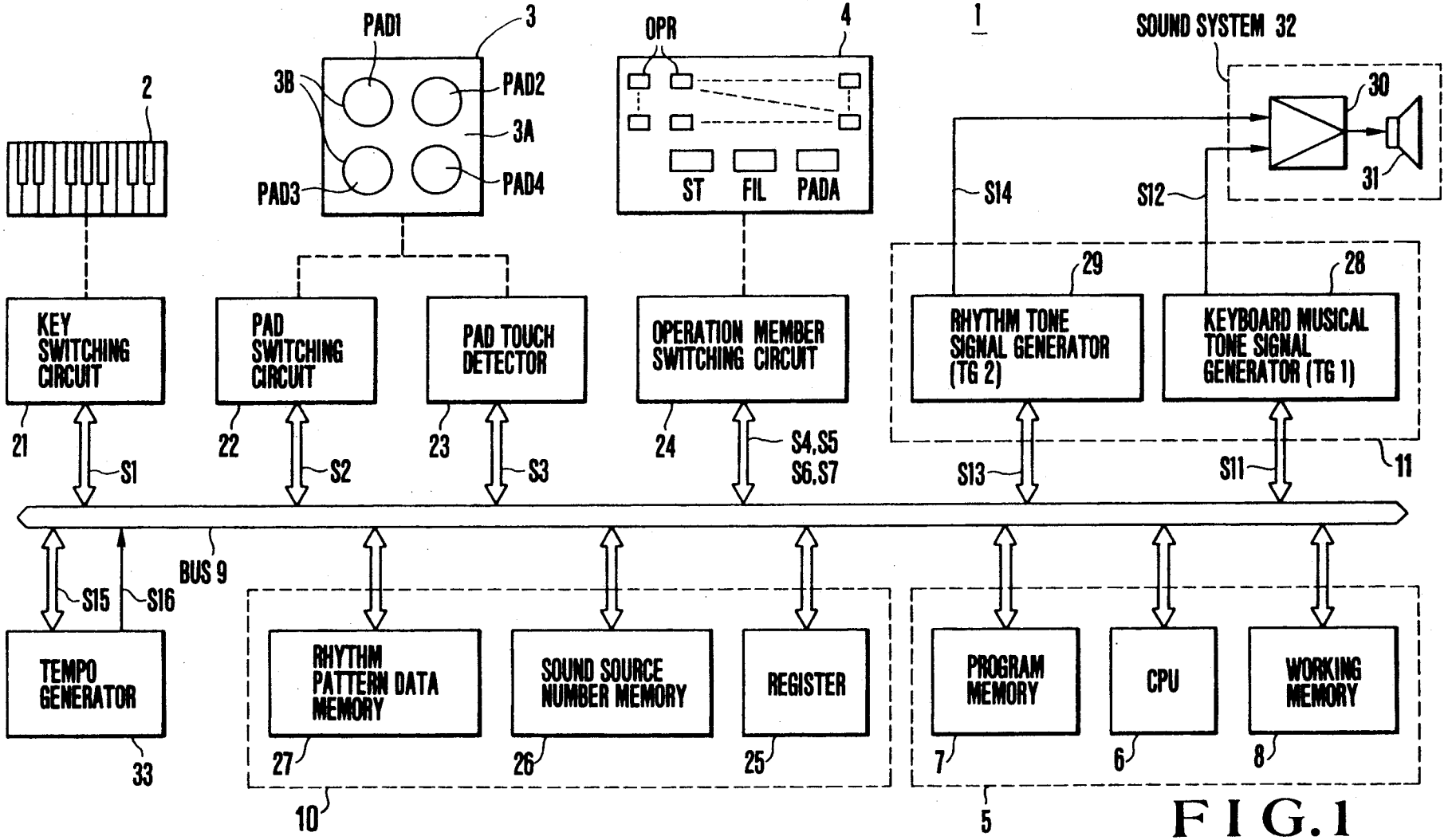
FIG. 1 is a block diagram showing a first embodiment of an electronic musical instrument according to the present invention.

Referring to FIG. 1 reference numeral 1 generally denotes an electronic musical instrument comprising a keyboard 2 and a percussion unit 3 as performance operation units, and an operation panel 4 as a setting operation unit. A central processing unit (CPU) 6 of a data processing unit 5 having a microcomputer arrangement allows a working memory 8 to fetch through a bus 9 input information obtained by operating the keyboard 2, the percussion unit 3 or the operation panel 4 in accordance with a program of a program memory 7 having a ROM arrangement. The CPU 6 executes a main routine RT0 shown in FIG. 2 to cause registers 25 (FIG. 3), a sound source number memory 26 and a rhythm data memory 27 of a data memory unit 10 to process and store data or to send the data to a musical tone signal generating unit 11.

Key information S1 corresponding to each key on the keyboard 2 is supplied from a key switching circuit 21 to the data processing unit 5 through the bus 9.

In this embodiment, the percussion unit 3 comprises a plurality of, e.g., four pads PAD1 to PAD4 arranged as performance operating members 3B on a board 3A. When any of the pads PAD1 to PAD4 is operated (i.e., a pad ON event occurs), a pad switch ON signal S2 corresponding to the operated pad is supplied from the pad switching circuit 22 to the data processing unit 5 through the bus 9. At the same time, pad touch detection data S3 representing a striking force of the performance operation to the operated one of the pads PAD1 to PAD4 is supplied from a pad touch detector 23 to the data processing unit 5 through the bus 9.

Figure 4:
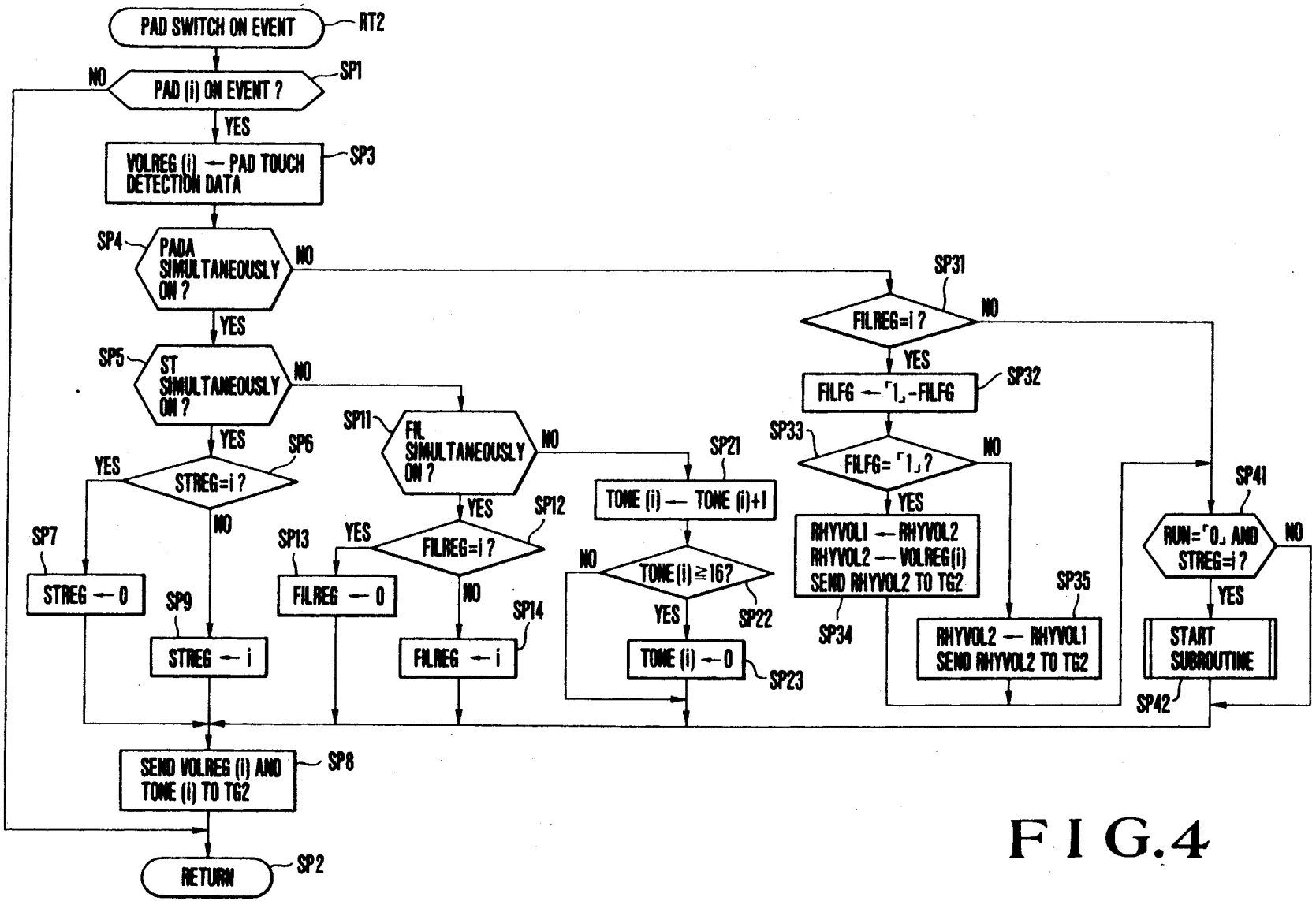
FIG. 4 is a flow chart for explaining a pad switch ON event subroutine shown in FIG. 2.

When the CPU 6 receives the pad switch ON signal S2, it executes a pad switch ON subroutine RT2 (FIG. 4).

The operation panel 4 comprises a start switch ST, a fill-in switch FIL, a pad assigning switch PADA and other operating members OPR.

Figure 6:
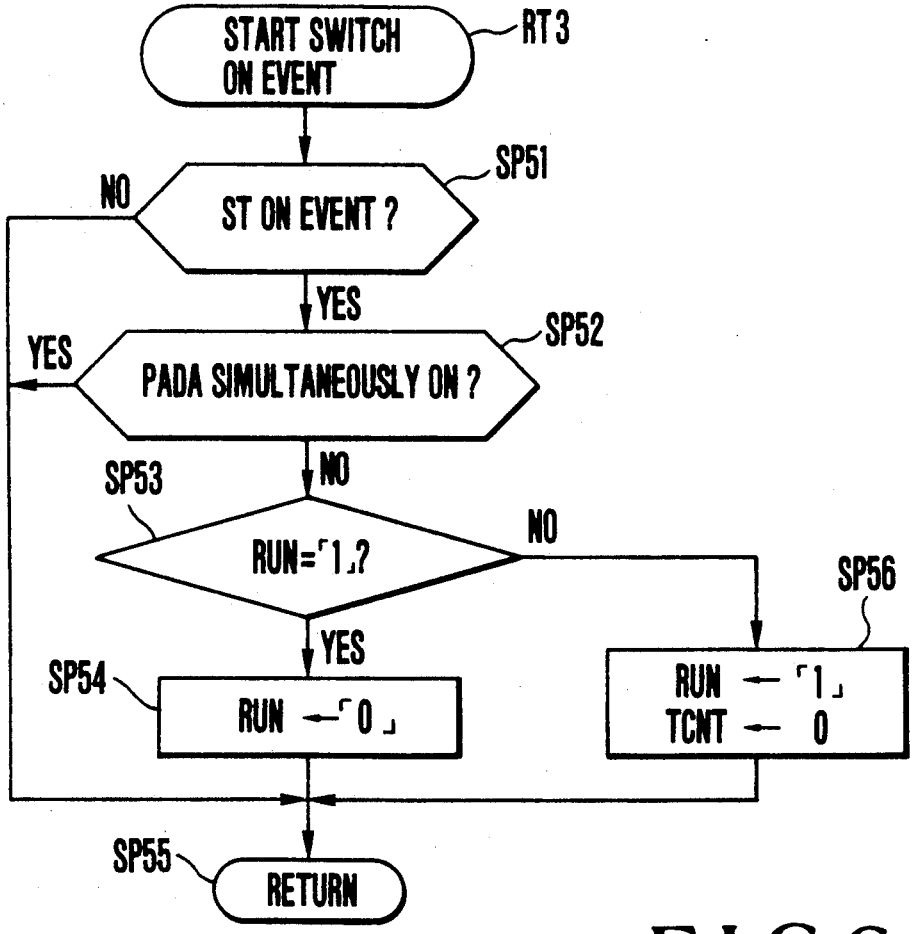
FIGS. 6, 7 and 8 are flow charts for explaining a start switch ON event subroutine, a fill-in switch ON event subroutine and a rhythm select subroutine shown in FIG. 2, respectively.

When the start switch ST is depressed by a performer to start or stop rhythm performance, it supplies a start switch signal S4 to the CPU 6, thereby inputting an instruction for executing a start switch ON event subroutine RT3 (FIG. 6).

Figure 7:
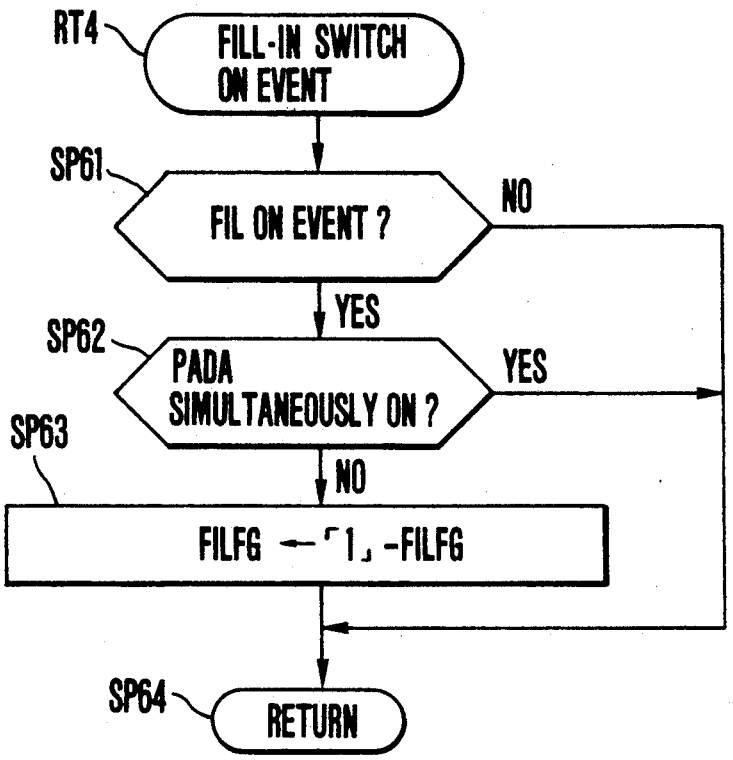

When the fill-in switch FIL is depressed by a performer during rhythm performance, it supplies a fill-in switch ON signal S5 to the CPU 6, thereby inputting an instruction for executing a fill-in ON event subroutine RT4 (FIG. 7).

The pad assigning switch PADA is operated so that a performer can designate an operation mode of the pads PAD1 to PAD4 of the percussion unit 3. That is, in addition to an original function as an operation inputting means for generating a percussion sound, each of the pads PAD1 to PAD4 can function as a start switch in place of the start switch ST, as a fill-in switch in place of the fill-in switch FIL or as a rhythm sound source selecting means, if necessary. When the pad assigning switch PADA is turned on, it causes an operating member switching circuit 24 to send a pad assigning switch ON signal S6.

Other operating members OPR supply operating member ON signals S7 including volume, tone-color, rhythm selection, and effect signals from the operating member switching circuit 24 to the CPU 6 in accordance with operations of a performer.

Figure 2:
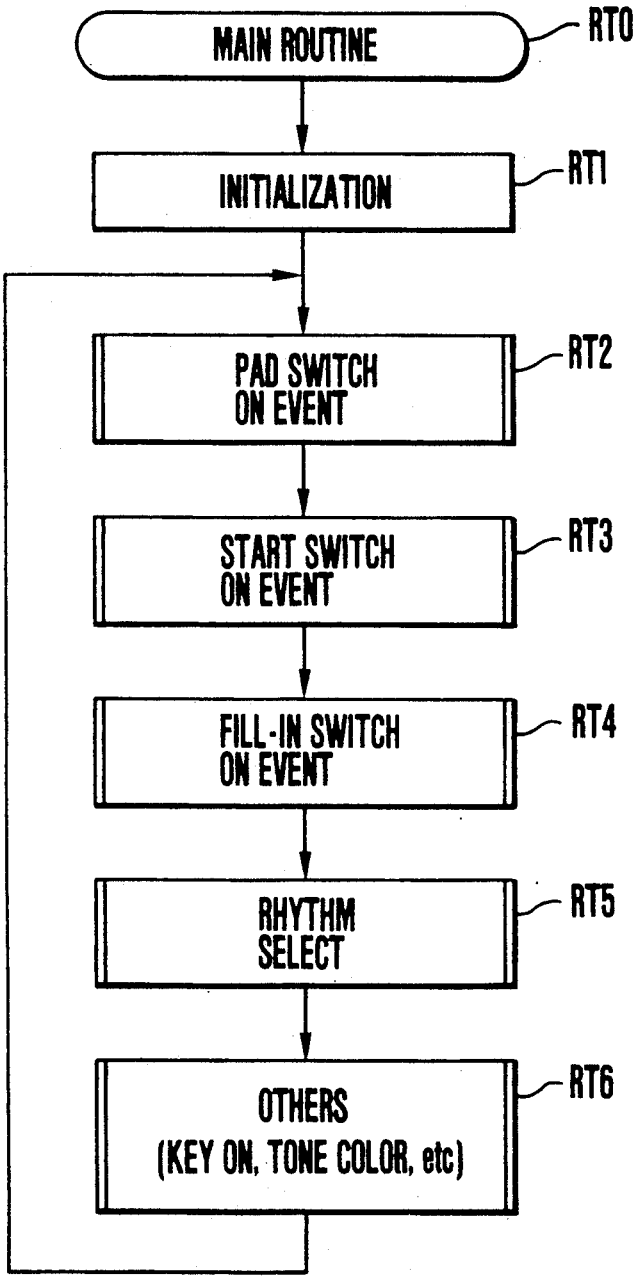
FIG. 2 is a flow chart for explaining a main routine executed by a CPU 6 shown in FIG. 1.
Figure 3:
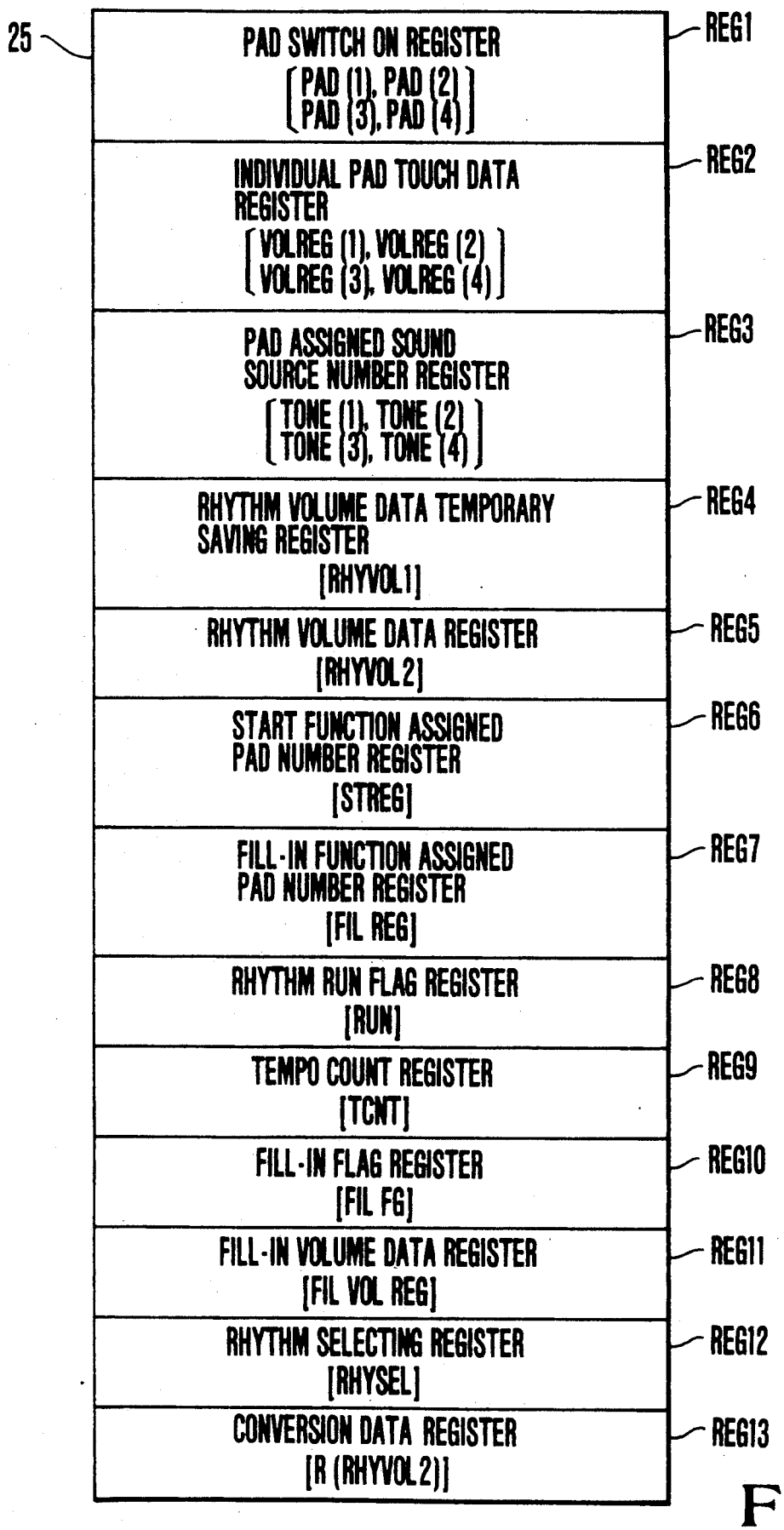
FIG. 3 is a schematic view showing an arrangement of registers 25 shown in FIG. 1.

When the CPU 6 executes the main routine RT0 shown in FIG. 2, a keyboard musical tone signal generator (TG1) 28 is supplied with a main musical tone generation information S11 and generates a main musical tone signal S12 on the basis of the key information S1, and a rhythm tone signal generator (TG2) 29 is supplied with rhythm tone generation information S13 and generates a rhythm tone signal S14 on the basis of a setting operation of the operation panel 4 and a performance operation of the pads PAD1 to PAD4 of the percussion unit 3. As a result, a sound system having an amplifier 30 and a loudspeaker 31 generates a musical tone.

Figure 8:
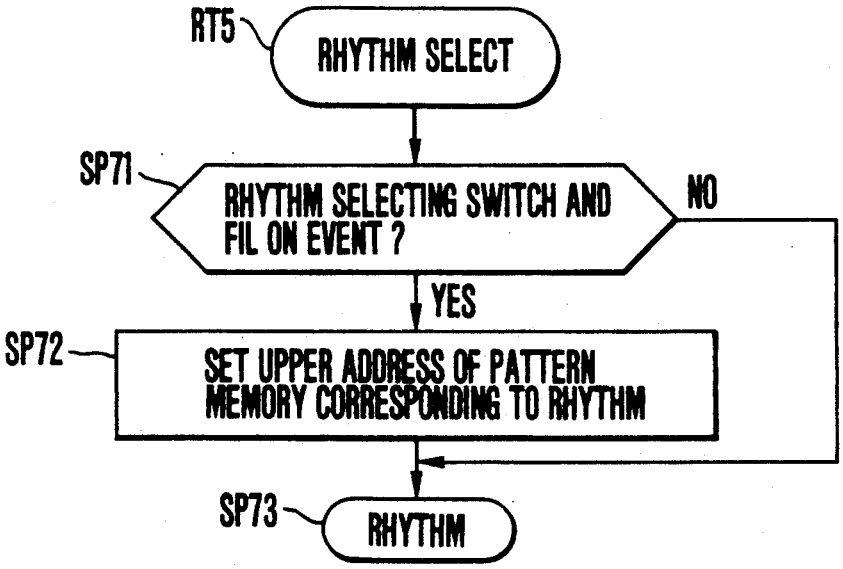

The rhythm tone generation information S13 is generated by executing a rhythm select subroutine (FIG. 8) on the basis of the operating member ON signal S7 obtained from a rhythm selecting switch included in other operating members OPR and by executing a rhythm interruption subroutine (FIG. 9) on the basis of a rhythm interruption signal S16 supplied together with a tempo information signal S15 from a tempo oscillator 33.

(2) Main Routine

When the CPU 6 starts the main routine RT0, initialization is executed in step RT1 so that data in the registers 25 are initialized.

Subsequently, the CPU 6 executes the pad switch ON event subroutine in step RT2. In this subroutine, as shown in FIG. 4, when the pad switch ON signal S2 is generated by operating the pads PAD1 to PAD4 of the percussion unit 3, a performer turns on the start switch ST, the fill-in switch FIL and the pad assigning switch PADA in a combination if necessary and at the same time strikes the pads PAD1 to PAD4 with sticks. As a result, a function as a start switch for starting or stopping a rhythm performance, an operation of inserting a fill-in mode if necessary, and a rhythm sound source of a percussion sound used in a rhythm performance are assigned to the pads PAD1 to PAD4.

Thereafter, the CPU 6 executes the start switch ON event subroutine in step RT3. In step RT3, processing of starting or stopping a rhythm performance is executed as shown in FIG. 6.

The flow advances to step RT4, and the CPU 6 executes the fill-in switch ON event subroutine. In step RT4, the fill-in mode is inserted as shown in FIG. 7.

Subsequently, the CPU 6 executes the rhythm select subroutine in step RT5. At this time, the CPU 6 executes a subroutine shown in FIG. 8.

In this manner, the CPU completes data processing related to rhythm performance, and executes other processing, e.g., processing of the key information S1 obtained by the key switching circuit 21 or processing of tone colors set by other operating members OPR. The flow then returns to step RT2.

Thereafter, the CPU 6 repeatedly executes the processing from steps RT2 to RT6, thereby sequentially processing the key information S1 fetched from the key switching circuit 21; the pad switch ON signal S2 fetched from the pad switching circuit 22; the pad touch detection data S3 fetched from the pad touch detector 23; the start switch ON signal S4, the fill-in switch ON signal S5 and the pad assigning switch ON signal S6 fetched from the operating member switching circuit 24; and the data obtained by the operating member ON signal S7, for each of a tone generation channel determined by the key information S1 and those of the pads PAD1 to PAD4. As a result, main musical tones having the number of musical tones which can be simultaneously generated and rhythm tones corresponding to the pads PAD1 to PAD4 are practically, simultaneously generated.

(3) Pad Switch ON Event Subroutine

When the CPU 6 starts the pad switch ON event subroutine RT2 (FIG. 4), it checks in step SP1 whether an ON event occurs on an ith pad PAD(i) (i=1, 2, 3 or 4). If NO in step SP1, the flow returns from SP2 to the main routine without executing any processing.

If YES in step SP1, the CPU 6 writes and holds pad touch detection data S3 as individual pad touch data VOLREG(i) obtained for the pad PAD(i) in an individual pad touch data register REG2 of the registers 25 (FIG. 3) in step SP3, and the flow advances to step SP4.

In step SP4, the CPU 6 checks whether the pad assigning switch PADA is simultaneously turned on.

If YES in step SP4, the CPU 6 determines that a performer executes an operation for assigning a start function, a fill-in function or a sound source selecting switching function required for a rhythm performance to the pad PAD(i). If NO in step SP4, the CPU 6 determines that no assigning operation is executed.

If YES in step SP4, therefore, the CPU 6 checks in step SP5 whether the start switch ST is simultaneously turned on.

If YES in step SP5, the CPU 6 determines that the performer intends to switch the switching function assigned to the pad PAD(i). The flow therefore advances to step SP6, and the CPU 6 reads out start function assigned pad number data STREG from a start function assigned pad number register REG6 of the register 25 (FIG. 3) and checks whether the content of the data STREG is i.

If YES in step SP6, the CPU 6 determines that the function as a start switch is already assigned to the pad PAD(i). The CPU 6 therefore rewrites the value of the start function assigned pad number data STREG to 0 in step SP7, thereby releasing the start function assigned to the pad PAD(i). The flow then advances to step SP8.

In this embodiment, the number of pads is four. Therefore, if i=0 is written in the start function assigned pad number data STREG while the pad number is i=1 to 4, the start function cannot be assigned to any of the pads PAD1 to PAD4.

In step SP8, a tone generation routine is executed. That is, the CPU 6 supplies the ith individual pad touch data VOLREG(i) stored in the individual pad touch data register REG2 of the registers 25 (FIG. 3) and an ith pad assigned sound source number data TONE(i) of a pad assigned sound source number register REG3 thereof to the TG2 29. Thereafter, the flow returns from step SP2 to the main routine.

The TG2 29 causes the sound system 32 to generate a rhythm tone of a rhythm sound source represented by the pad assigned sound source number data TONE(i) in a volume represented by the individual pad touch data VOLREG(i).

If NO in step SP6, the CPU 6 determines that the ith pad PAD(i) is not assigned to the start function assigned pad number data STREG. The CPU 6 therefore rewrites the value of the start function assigned pad number data STREG to 1 in step SP9, and the flow advances to step SP8.

In this manner, when the performer simultaneously turns on the pad assigning switch PADA (step SP4) and the start switch ST (step SP5), the CPU 6 rewrites assignment of the start function to the ith pad PAD(i).

If NO in step SP5, the CPU 6 determines that the performer intends to assign a function other than the start function, i.e., the fill-in function or the sound source selecting switching function to the ith pad PAD(i).

The CPU 6 therefore checks in step SP11 whether the fill-in switch FIL is simultaneously turned on. If YES in step SP11, the CPU 6 determines that the performer intends to assign the fill-in function to the ith pad PAD(i). The CPU 6 therefore checks in step SP12 whether the content in fill-in function assigned pad number data FILREG held in a fill-in function assigned pad number register REG7 is i.

If YES in step SP12, the CPU 6 determines that the function as a fill-in switch is already assigned to the ith pad PAD(i). The CPU 6 therefore rewrites the value of the fill-in function assigned pad number data FILREG to 0 in step SP13, thereby releasing the fill-in function assigned to the ith pad PAD(i) as in the case of the start function. The flow then returns to the main routine through steps SP8 and SP2.

If NO in step SP12, the CPU 6 determines that the fill-in function is not assigned to the ith pad PAD(i). The CPU 6 therefore rewrites the value of the fill-in function assigned pad number data FILREG to i in step SP14. The flow then returns to the main routine through steps SP8 and SP2.

In this manner, when the performer simultaneously turns on the pad assigning switch PADA and the fill-in switch FIL, the CPU 6 executes the processing of rewriting assignment of the fill-in function to the ith pad PAD(i).

If NO in step SP11, the CPU 6 determines that the performer intends to assign the function as a sound source selecting switch to the ith pad PAD(i).

The flow therefore advances to step SP21, and the CPU 6 increments the pad assigned sound source number data TONE(i) of the pad assigned sound source number register REG3 by "1" and writes this result as new pad assigned sound source number data. The flow then advances to step SP22.

The pad assigned sound source number data TONE(i) represents the number (in this embodiment, 0 to 15) of rhythm sources assignable to the ith pad PAD(i).

In step SP22, the CPU 6 checks whether the pad assigned sound source number data TONE(i) incremented by "1" exceeds a maximum sound source number, i.e., 16. If NO in step SP22, the flow immediately returns to the main routine through steps SP8 and SP2. If YES in step SP22, the flow advances to step SP23, and the CPU 6 rewrites the value of the pad assigned sound source number data TONE(i) to 0. The flow then returns to the main routine through steps SP8 and SP2.

In this manner, when the performer turns on only the pad assigning switch PADA and strikes the ith pad PAD(i) with a stick, the CPU 6 designates the next sound source number after the sound source number currently designated.

In this embodiment, the TG2 29 can designate 16 rhythm sound sources. For example, if the values of the pad assigned sound source number data TONE(i) are 0, 1, 2, 15, rhythm tones of a bass drum, a snare drum, a conga drum, . . . , a hi-hat close can be designated as rhythm sound sources. In this manner, each time the pad PAD(i) is struck, the sound source number incremented by "1" is assigned to the pad PAD(i) in step SP21. When the sound source number is incremented to be 16 (i.e., beyond the maximum sound source number 15) the pad assigned sound source number data TONE(i) is returned to the sound source of the sound source number 0 in step SP23 to enable designation from 0 to 15 again.

In this manner, the pad assigning switch PADA is operated as an assignment information registering means for storing and registering the pad assigned sound source number data TONE(1) to TONE(4) serving as assignment information representing the types of rhythm sound sources to be assigned to the pads PAD1 to PAD4 as the performance operating members, respectively, in the pad assigned sound source number register REG3. The pad assigned sound source number register REG3 operates as an assignment information memory means for storing the assignment information.

If NO in step SP4, the CPU 6 determines that the performer does not intend to assign any of the start function, the fill-in function, and the sound source selecting function to the ith pad PAD(i). The CPU 6 therefore checks in step SP31 whether the value of the fill-in function assigned pad number data FILREG of the fill-in function assigned pad number register REG7 in the register 25 (FIG. 3) is i.

If YES in step SP31, the CPU 6 determines that the performer intends to insert a fill-in performance in a currently executed rhythm performance. The flow therefore advances to step SP32, and the CPU 6 executes calculation of "1"—FILFG on the basis of fill-in flag data FILFG of a fill-in flag register REG10 of the registers (FIG. 3) and writes this result as new fill-in flag data FILFG.

In this manner, if the current fill-in flag data FILFG is logic "1" (or "0"), the new fill-in flag data FILFG is switched to logic "0" (or "1") by inverting the logic level.

Subsequently, the CPU 6 checks in step SP33 whether the rewritten fill-in flag data FILFG is logic "1". If YES in step SP33, the flow advances to step SP34, and the CPU 6 transfers rhythm volume data RHYVOL2 in a rhythm volume register REG5 of the registers 25 (FIG. 3) as rhythm volume data temporary saving data RHYVOL1 to a rhythm volume data temporary saving register REG4, writes the individual touch data VOLREG(i) as new rhythm volume data RHYVOL2, and then sends the rhythm volume data RHYVOL2 as rhythm tone generation information S13 to the TG2 29.

In this manner, in step SP34, the rhythm volume data RHYVOL2 representing the volume of the currently generated rhythm tone by the TG2 29 is temporarily saved as the rhythm volume data temporary saving data RHYVOL1, and the new individual pad touch data VOLREG(i) representing the pad touch detection data S3 obtained because the ith pad PAD(i) is currently operated is rewritten to the rhythm volume data RHYVOL2, thereby changing the volume of the rhythm tone to a volume corresponding to the latest pad touch detection data S3.

If NO in step SP33, the flow advances to step SP35, the CPU 6 rewrites the rhythm volume data temporary saving data RHYVOL1 stored in the rhythm volume data temporary saving register REG4 to the rhythm volume data RHYVOL2 of the rhythm volume data register REG5 and sends the rhythm volume data RHYVOL2 as the rhythm tone generation information S13 to the TG2 29.

In this manner, the CPU 6 controls the system to generate the rhythm tone in a volume corresponding to the previous rhythm volume data once stored as the rhythm volume data temporary saving data RHYVOL1.

As a result, in step SP34, the CPU 6 switches the volume of the current fill-in performance to a performance volume corresponding to the intensity of a performance operation amount applied by striking the pad PAD(i). Thereafter, when the pad PAD(i) is struck at an arbitrary timing, the CPU can return the volume of the fill-in performance to the original one in step SP35.

In this manner, a lively fill-in performance can be executed in accordance with an operation of the performer.

When the processing in step SP34 or SP35 is completed, or if NO is determined in step SP31, the flow advances to step SP41. In step SP41, the CPU 6 determines whether a rhythm run flag RUN of a rhythm run flag register REG8 of the registers 25 (FIG. 3) is logic "0" (i.e., a rhythm performance state is not set) and the content of the start function assigned pad number data STREG of the start switching start function assigned pad number register REG6 is i.

If YES in step SP41, the CPU 6 determines that the start function is already assigned to the pad PAD(i) but a rhythm performance is not started yet. The CPU 6 therefore executes a start subroutine in step SP42.

Figure 5:
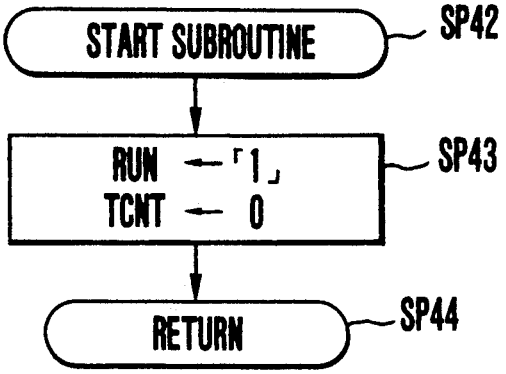
FIG. 5 is a flow chart for explaining a start subroutine shown in FIG. 4.

In start subroutine SP42, as shown in FIG. 5, the CPU 6 rewrites the rhythm run flag data RUN to data of logic "1" and rewrites the value of tempo count data TCNT of a tempo count register REG9 of the registers 25 (FIG. 3) to "0", thereby resetting the tempo count register REG9. Thereafter, the flow returns from step SP44 to the pad switch ON event subroutine RT2 (FIG. 4) and then returns to the main routine through steps SP8 and SP2.

In this manner, when the CPU 6 determines that the start function is already assigned to the ith pad PAD(i) but a rhythm performance is not started yet, it resets the state so that the rhythm performance can be started.

If NO in step SP41, the CPU 6 determines that an automatic rhythm performance is already started when the start function is assigned to the pad PAD(i) or that the start function is not assigned to the pad PAD(i). In this case, since a rhythm performance needs not be started, the flow jumps step SP42 and returns to the main routine through steps SP8 and SP2.

(4) Start Switch ON Event Subroutine

The CPU 6 executes a start switch ON event subroutine RT3 (FIG. 6) as follows.

That is, in step SP51, the CPU 6 checks whether an ON event occurs in the start switch ST. If YES in step SP51, the CPU 6 checks in step SP 52 whether the pad assigning switch PADA is simultaneously turned on.

If NO in step SP52, the CPU 6 determines that the performer turns on only the start switch ST (neither the fill-in switch FIL nor the pad assigning switch PADA are turned on). The CPU 6 therefore checks in step SP53 whether the rhythm run flag RUN is logic "1". If YES in step SP53, the CPU 6 rewrites the rhythm run flag data RUN to logic "0", and the flow returns from step SP55 to the main routine.

If NO in step SP53, the flow advances to step SP56, and the CPU 6 rewrites the rhythm run flag data RUN to logic "1" and resets the value of the tempo count data TCNT to 0, thereby starting a rhythm performance. The flow then returns from step SP55 to the main routine.

In this manner, when the pad PAD(i) is operated while the performer turns on only the start switch ST and a rhythm performance is already started (or not started yet), the CPU 6 stops (or starts) the rhythm performance.

If NO in step SP51 or YES in step SP52, the flow jumps steps SP52, SP53 and SP54 or steps SP53 and SP54, respectively, and then returns from step SP55 to the main routine.

(5) Fill-In Switch ON Event Subroutine

In a fill-in switch ON event subroutine RT4 of the main routine RT0 (FIG. 2), as shown in FIG. 7, the CPU checks in step SP61 whether an ON event occurs in the fill-in switch FIL. If YES in step SP61, the CPU 6 checks in step SP62 whether the pad assigning switch PADA is simultaneously turned on. If NO in step SP62, the CPU 6 inverts the content of the fill-in flag data FILFG in step SP63, and the flow returns from step SP64 to the main routine.

In this manner, the CPU 7 inverts the content of the fill-in flag data FILFG each time the fill-in switch FIL is turned on, thereby stopping (or starting) a fill-in performance when the fill-in performance is executed (or not executed).

If NO in step SP61 or YES in step SP62, the flow jumps steps SP62 and SP63 or step SP63, respectively, and then returns from step SP64 to the main routine.

(6) Rhythm Select Subroutine

In step SP71 of a rhythm select subroutine RT5 (FIG. 8) of the main routine RT0 (FIG. 2), the CPU 6 checks whether an ON event occurs in the rhythm selecting switch included in other operating members OPR on the operation panel 4 and the fill-in switch FIL. If YES in step SP71, the flow advances to step SP72, and the CPU 6 sets an upper address of a pattern memory (stored in the rhythm pattern data memory 27 (FIG. 1)) corresponding to a rhythm selected by the rhythm selecting switch and sends the designated rhythm pattern as the rhythm tone generation information S13 to the TG2 29. The flow then returns from step SP73 to the main routine.

If NO in step SP71, the flow jumps to step SP73, and the CPU 6 ends the subroutine.

(7) Rhythm Interruption Subroutine

Figure 9:
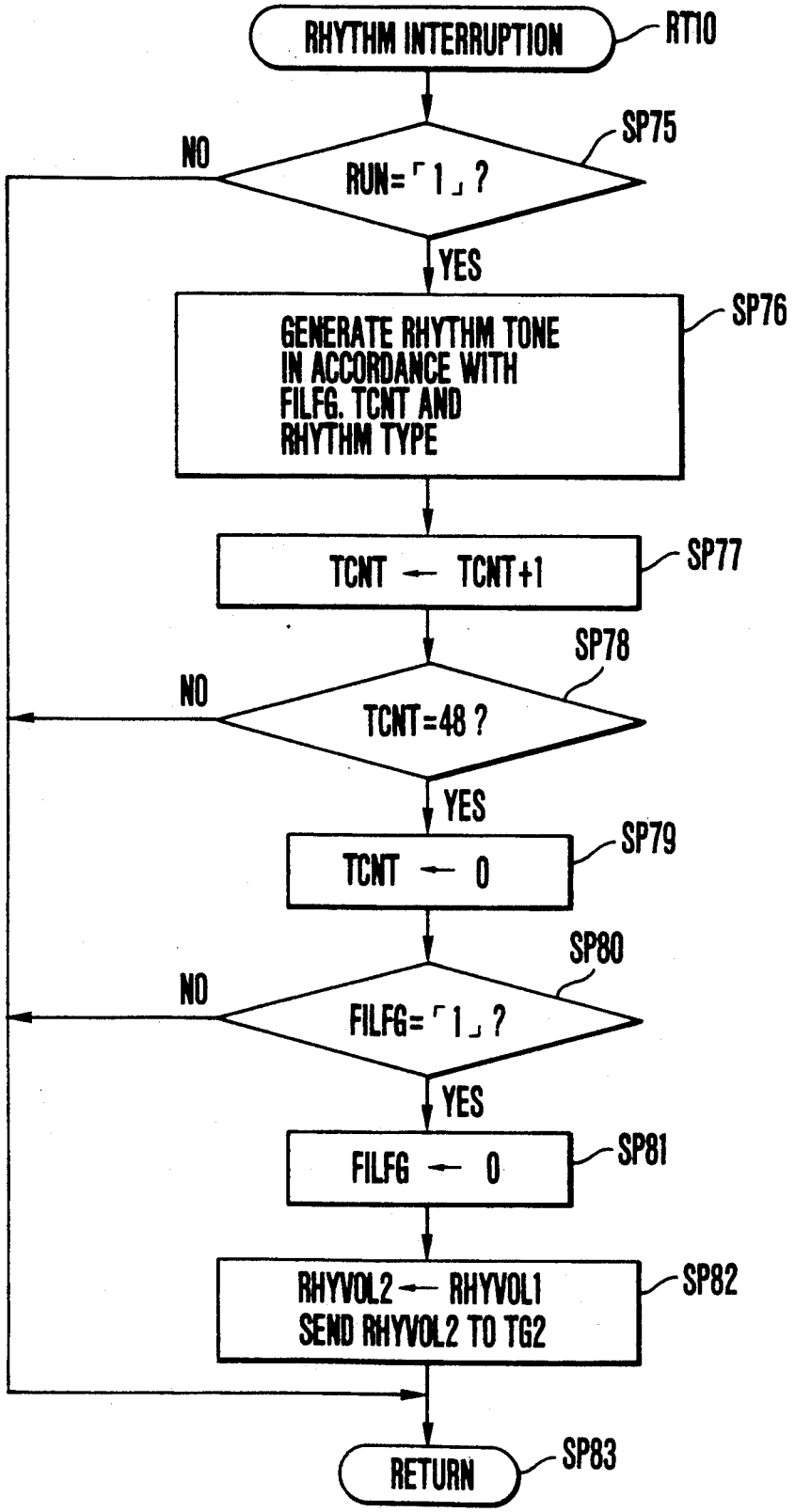
FIG. 9 is a flow chart for explaining a rhythm interruption subroutine.

If the tempo generator 33 generates a rhythm interruption signal S16 while the CPU 6 repeatedly executes the loop of the main routine RT0 (FIG. 2), the CPU 6 executes a rhythm interruption routine RT10 shown in FIG. 9 to control rhythm performance.

In step SP75, the CPU 6 checks whether the rhythm run flag data RUN is logic "1". If YES in step SP75 (i.e., when rhythm performance is currently being executed), the flow advances to step SP76, and the CPU 6 sends rhythm tone generation information S13 determined in accordance with the fill-in flag data FILFG, the tempo count data TCNT and the rhythm type designated in the rhythm select subroutine RT5 (FIG. 8) to the TG2 29, thereby generating a rhythm tone of a normal pattern or a fill-in pattern.

Subsequently, the CPU 6 increments the tempo count data TCNT by "1" in step SP77 and checks in step SP78 whether the value of the tempo count data TCNT obtained after it is incremented by "1" is 48.

In this embodiment, the CPU 6 counts clocks from a 0th clock time position to a 47th clock time position within one measure on the basis of the rhythm information S15 supplied from the tempo generator 33. If YES in step 78 (i.e., a rhythm performance of one measure is completed and that for the next measure is started), therefore, the CPU 6 resets the tempo count data TCNT by rewriting its value to 0 in step SP79 and checks in step SP80 whether the fill-in flag data FILFG is logic "1".

If YES in step SP80 (i.e., when the TG2 29 currently executes a rhythm performance by the fill-in pattern), the CPU 6 resets the value of the fill-in flag data FILFG to logic "0" in step SP81. Thereafter, in step SP82, the CPU 6 rewrites the rhythm volume data temporary saving data RHYVOL1 to the rhythm volume data RHYVOL2 and sends the rewritten data as the rhythm tone generation information S11 to the TG2 29.

At this time, the TG2 29 executes a tone generation operation such that the rhythm volume is returned from the volume corresponding to the rhythm volume data RHYVOL2 to that stored as the rhythm volume data temporary saving data RHYVOL1. In this manner, the rhythm interruption routine is completed, and the flow returns from step SP83 to the main routine.

When the fill-in pattern performance of one measure is completed and that for the next measure is started as described above, the TG2 29 is returned to the state for generating a rhythm tone of a normal pattern.

If NO in step SP75 (i.e., when no rhythm performance is executed when the rhythm interruption signal S16 is generated), the flow returns from step SP83 to the main routine.

If NO in step SP78 (i.e., when a measure to be performed by the fill-in pattern is not finished yet), the flow jumps to step SP83 and then returns to the main routine.

If NO in step SP80 (i.e., when the current rhythm performance is executed not by the fill-in pattern), the flow jumps to step SP83 and then returns to the main routine.

(8) Operation and Effect of First Embodiment

In the above arrangement, in order to assign the start function to the ith pad PAD(i) of the pads PAD1 to PAD4, the performer simultaneously turns on the pad assigning switch PADA and the start switch ST and strikes the ith pad PAD(i) with a stick.

In this case, since YESES are determined in steps SP4 and SP5 of the pad switch ON event subroutine RT2 (FIG. 4) on the basis of the pad switch ON signal S2, the CPU 6 inverts the current state in step SP7 or SP9 in accordance with whether the start function is currently assigned to the pad PAD(i).

The above processing of the CPU 6 allows the performer to assign the start function to an arbitrary pad or to release the function therefrom by striking one of the pads PAD1 to PAD4 of the electronic musical instrument 1 in an operation state, i.e., with such a comparatively simple operation.

In order to assign the fill-in function to the ith pad PAD(i) of the pads PAD1 to PAD4, the performer simultaneously turns on the pad assigning switch PADA and the fill-in switch FIL and strikes the pad PAD(i) with a stick.

At this time, in step SP13 or SP14, the CPU 6 inverts the fill-in function assigned pad number data FILREG in accordance with the current state of the fill-in function assigned pad number data FILREG by the loop of steps SP4–SP5–SP11–SP12 in the pad switch ON event subroutine RT2 (FIG. 4).

Also in this case, therefore, the performer can switch the performance of the fill-in pattern if necessary during a performance with a simple operation.

In order to assign a desired rhythm sound source to the ith pad PAD(i) of the pads PAD1 to PAD4, the performer needs only turn on the pad assigning switch PADA and operates the pad PAD(i).

At this time, the CPU 6 can increment the pad assigned sound source number data TONE(i) by "1" by the loop of steps SP4–SP5–SP11–SP21–SP22 in the pad switch ON event subroutine RT2 (FIG. 4) each time the pad PAD(i) is struck. As a result, by simply striking the pad PAD(i) until the desired sound source is set, the performer can assign the desired sound source.

In order to insert the fill-in pattern during rhythm performance, the performer needs only assign the fill-in function to the rhythm sound source.

That is, the performer simultaneously turns on the pad assigning switch PADA and the fill-in switch FIL and strikes the pad PAD(i) with a stick, and then turns off the pad assigning switch PADA.

At this time, the CPU can set the pad number i of the pad PAD(i) to the pad number data FILREG assigned with the fill-in function by the loop of steps SP4–SP5–SP11–SP12–SP14 in the pad switch ON event subroutine RT2 (FIG. 4). Subsequently, the CPU 6 can switch the rhythm volume data RHYVOL2 (representing the volume of the current rhythm tone) with the rhythm volume stored in the rhythm volume data temporary saving data RHYVOL1. As a result, switching between the fill-in pattern and the normal pattern can be easily executed.

[2] Second Embodiment

Figure 10:
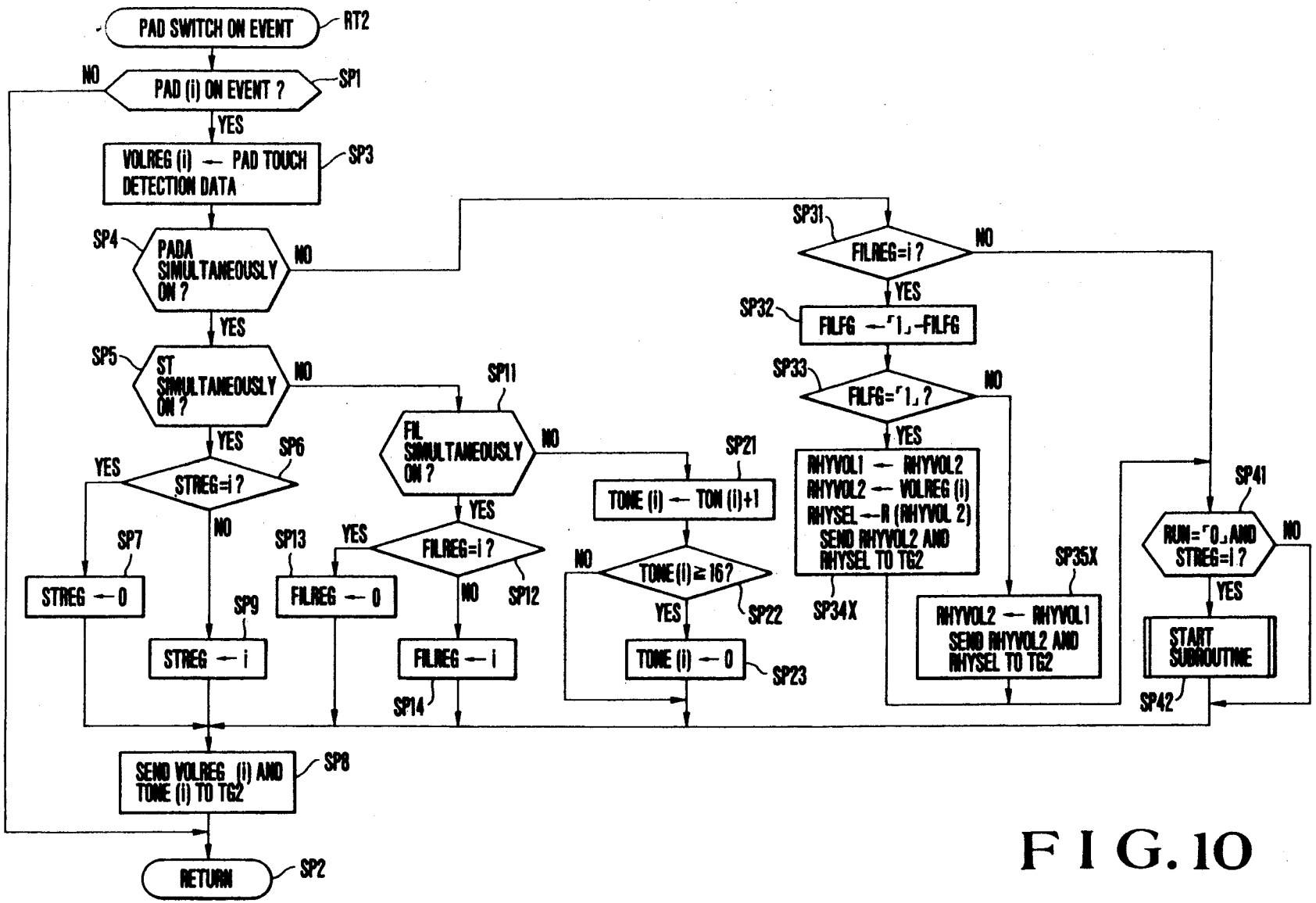
FIG. 10 is a flow chart for explaining a pad switch ON event subroutine according to a second embodiment.

FIG. 10 shows a second embodiment of the present invention. In the second embodiment, the same step numbers as in FIG. 4 denote the corresponding steps, and a CPU 6 executes processing in steps SP34X and SP35X in place of steps SP34 and SP35.

That is, in FIG. 10, If YES is determined in step SP33, the flow advances to step SP34X, and the CPU 6 stores rhythm volume data RHYVOL2 in rhythm volume data temporary saving data RHYVOL1, thereby rewriting individual touch data VOLREG(i) to the rhythm volume data RHYVOL2. At the same time, the CPU 6 converts the rhythm volume data RHYVOL2 to conversion data R(RHYVOL2), writes the data in a conversion data register REG13 (FIG. 3), and then writes the data as rhythm selection data RHYSEL in a rhythm selecting register REG12.

The conversion data R(RHYVOL2) roughly divides the rhythm volume data RHYVOL2 into low, middle and high ranges on the basis of a volume, thereby setting a rhythm selection signal RHYSEL for selecting a 0th, lst or 2nd rhythm as the conversion data R(RHYVOL2) corresponding to the low, middle or high range of the rhythm volume data RHYVOL2.

In addition, in step SP34X, the CPU 6 supplies the rhythm volume data RHYVOL2 and the rhythm selection data RHYSEL to a rhythm tone signal generator (TG2) 29.

At this time, the TG2 29 generates a rhythm tone of a rhythm selected by the rhythm selection data RHYSEL in a volume corresponding to the rhythm volume data RHYVOL2.

If NO in step SP33, the flow advances to step SP35X, and the CPU 6 resets the rhythm volume data temporary saving data RHYVOL1 to the rhythm volume data RHYVOL2 and sends the rhythm volume data RHYVOL2 and the rhythm selection data RHYSEL to the TG2 29.

As a result, the TG2 29 generates a rhythm tone of a rhythm designated by the rhythm selection data RHYSEL in a volume designated by the rhythm volume data RHYVOL2.

According to the arrangement shown in FIG. 10, the performer simultaneously turns on a pad assigning switch PADA and a fill-in switch FIL and strikes a pad PAD(i) to assign a fill-in function and set pad number data FILREG in step SP14, and then turns off the pad assigning switch PADA. As a result of this simple operation, upon switching between a fill-in pattern and a normal pattern, a tone color can be changed together with a volume, thereby realizing a more lively performance.

[3] Third Embodiment

Figure 11:
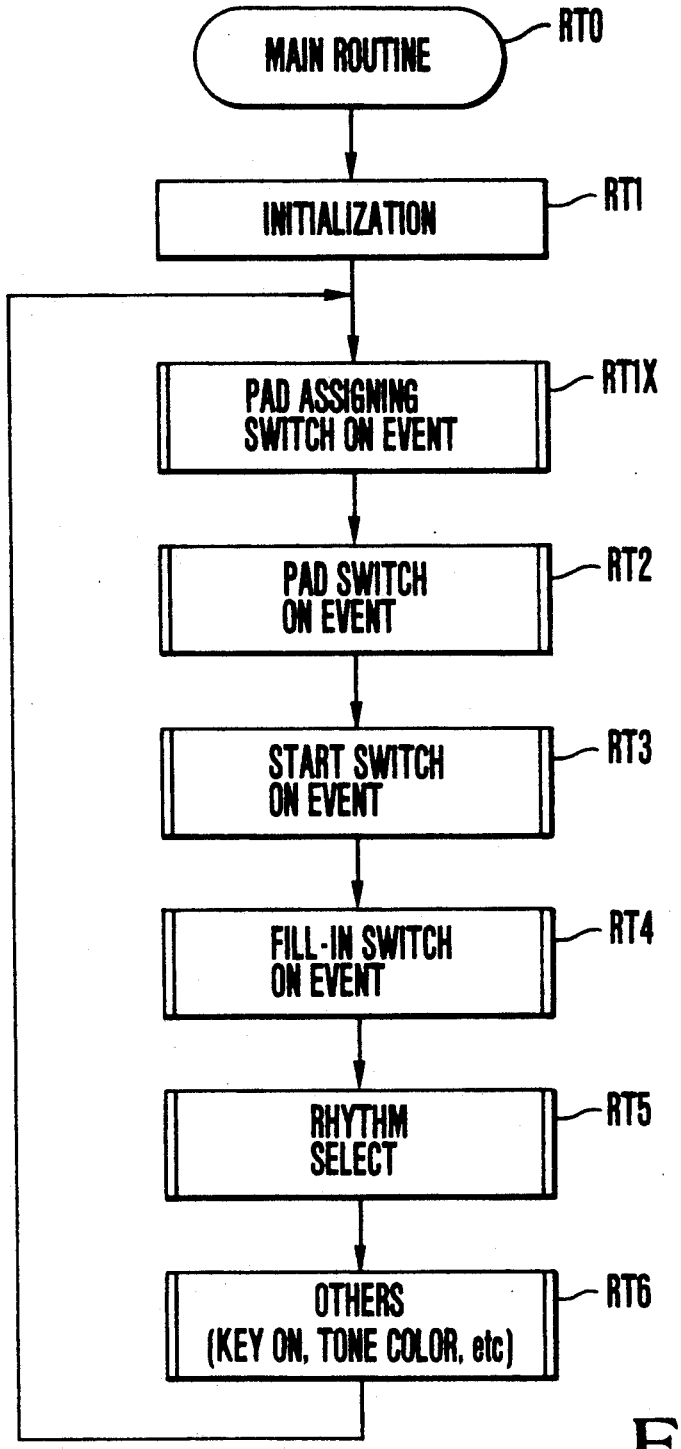
FIGS. 11, 12 and 13 are flow charts for explaining a main routine, a pad assigning switch ON event subroutine and a pad switch ON event subroutine according to a third embodiment of the present invention, respectively.
Figure 12:
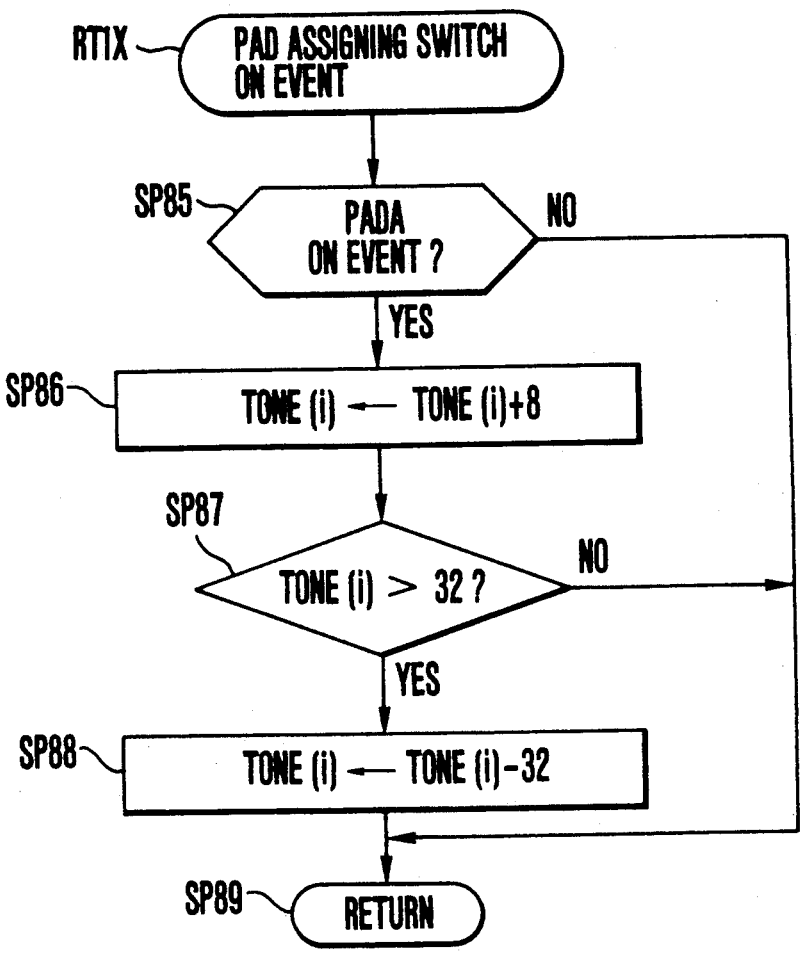
Figure 13:
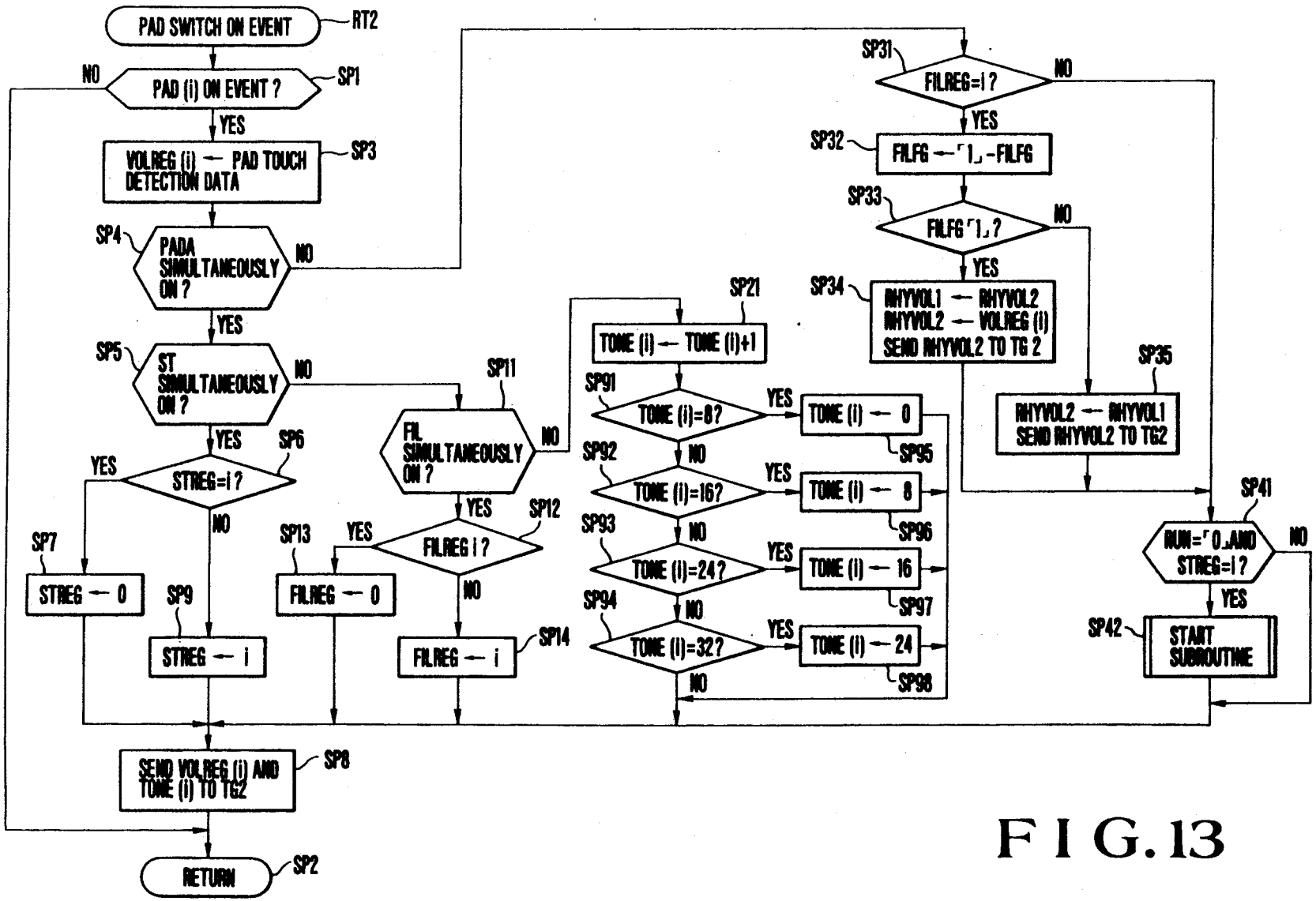

FIGS. 11 to 13 show a third embodiment of the present invention. Referring to FIG. 11 in which the same step numbers as in FIG. 2 denote the corresponding steps, a pad assigning switch ON event subroutine RT1X is executed between initialization in a subroutine RT1 and a pad switch ON event subroutine RT2 shown in FIG. 2.

In the third embodiment, 32 rhythm sound sources are divided into four sound source groups in accordance with their tone colors, i.e., a group of 0th to 7th rhythm sound sources, that of 8th to 15th rhythm sound sources, that of 16th to 23rd rhythm sound sources, and that of 24th to 31st rhythm sound sources. Each rhythm sound source group is assigned with sound sources having the same type of tone colors.

For example, a bass drum, bongos, a conga drum and the like are classified as drum-like sound sources into a plurality of musical instrument groups, and a hi-hat cymbal, a top cymbal, a rim shot and the like are classified as cymbal-like musical instruments into one or a plurality of rhythm sound source groups.

In the pad assigning switch ON event subroutine RT1X, a processing program as shown in FIG. 12 is executed. In addition, a subroutine as shown in FIG. 13 is executed as the pad switch ON even subroutine RT2.

Referring to FIG. 12, when the pad assigning switch ON event subroutine RT1X is started, a CPU 6 checks in step SP85 whether an ON event occurs in a pad assigning switch PADA. If YES in step SP85, the flow advances to step SP86, and the CPU 6 increments pad assigned sound source number data TONE(i) to be assigned to an ith pad PAD(i) by "8" as a sound source number, thereby designating new pad assigned sound source number data TONE(i).

With this processing in step SP86, the content of the pad assigned sound source number data TONE(i) can be incremented by "8" each time a performer turns on the pad assigning switch PADA. That is, a sound source number in the four sound source groups comprising the 0th to 7th, 8th to 15th, 16th to 23rd, and 24th to 31st rhythm sound sources can be discontinuously designated.

In step SP87, the CPU 6 checks whether the pad assigned sound source number data TONE(i) incremented by "8" exceeds the maximum sound source number 32. If YES in step SP87, the flow advances to step SP88, and the CPU 6 decrements by "32" the pad assigned sound source number data TONE(i) incremented by "8", thereby designating the first rhythm sound source group (i.e., the 0th to 7th sound sources).

If NO in step SP87, the flow jumps step SP88 and returns from step SP89 to the main routine.

If NO in step SP85, the flow returns from step SP89 to the main routine without incrementing the pad assigned sound source number data TONE(i) by "8".

In the pad switch ON event subroutine RT2 shown in FIG. 13, the CPU 6 executes processing different from that shown in FIG. 4 as follows.

That is, referring to FIG. 13 in which the same step numbers as in FIG. 4 denote the corresponding steps, the CPU 6 executes a processing step for allowing a performer to designate a desired sound source in order to realize a sound source selecting switching function by a loop of steps SP4–SP5–SP11–SP21.

That is, the CPU 6 increments pad assigned sound source number data TONE(i) by "1" in step SP21, and then sequentially executes determination processing in steps SP91, SP92, SP93 and SP94, thereby sequentially checking whether the pad assigned sound source number data TONE(i) incremented by "1" is 8, 16, 24 or 32.

In this processing, the CPU 6 checks whether the pad assigned sound source number data TONE(i) is the start number of each sound source group, i.e., the start number 8 of the second group, the start number 16 of the third group, the start number 24 of the fourth group, or the start number 32 (or 0) of the first group.

If YES in step SP91, SP92, SP93 or SP94, the CPU 6 sets the start number 0, 8, 16 or 24 of the 1st, 2nd, 3rd or 4th group in step SP95, SP96, SP97 or SP98. As a result, the performer can designate desired sound sources from the start-number sound source of each sound source group, and tones of the designated sound sources can be sequentially generated in step SP8.

According to the operations shown in FIGS. 11 to 13, in order to select and assign a very large number of, e.g., 32 sound sources to four pads PAD1 to PAD4 as performance operating members, the sound sources are divided into the sound source groups beforehand on the basis of their tone colors so that the performer can search for a desired sound source from each sound source group. Therefore, the performer needs not execute a cumbersome operation to select a desired sound source.

[4] Fourth Embodiment

Figure 14:
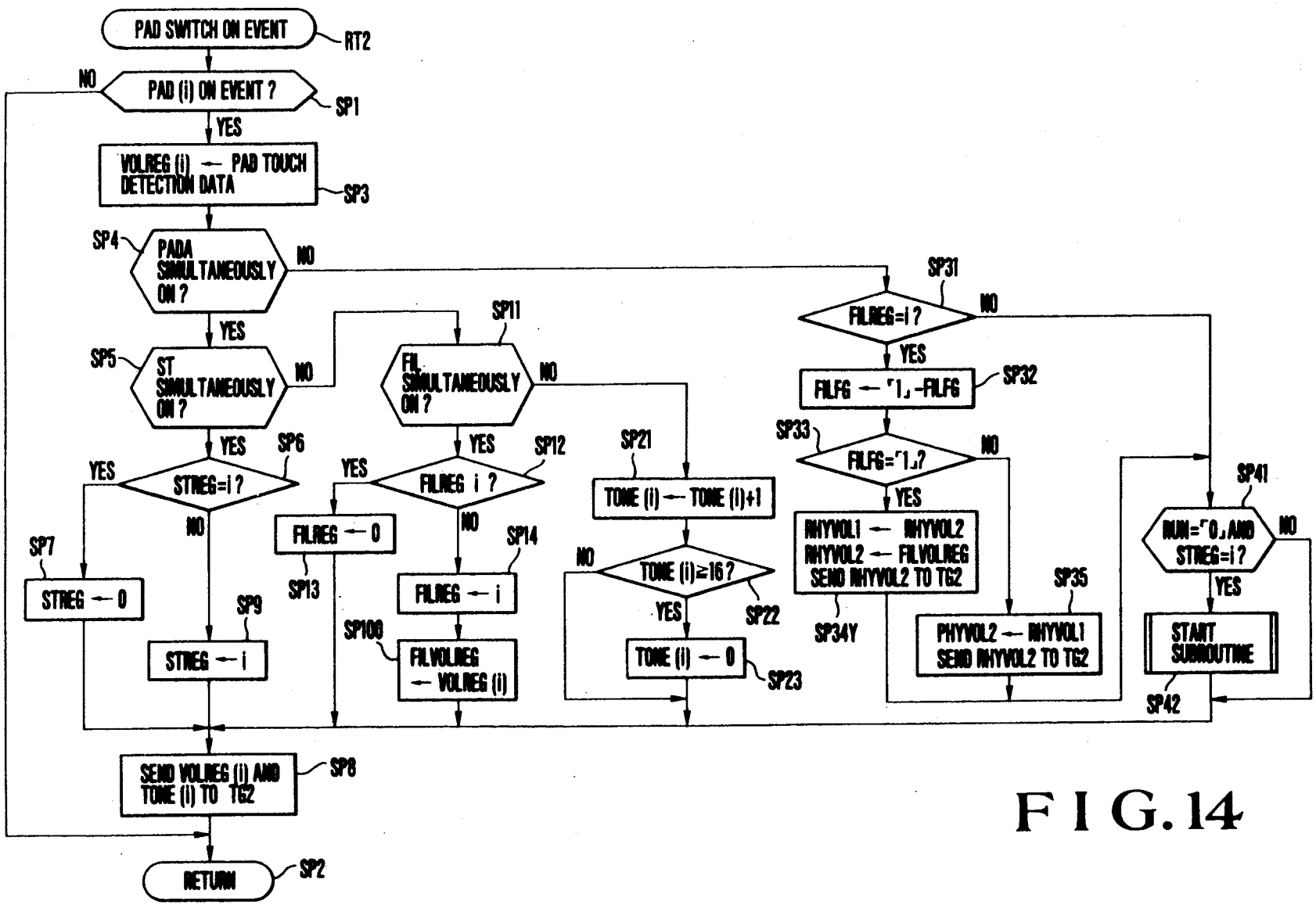
FIG. 14 is a flow chart for explaining a pad switch ON event subroutine according to a fourth embodiment of the present invention.

FIG. 14 shows a fourth embodiment of the present invention, in which the same step numbers as in FIG. 4 denote the corresponding steps. That is, similar to the processing described above with reference to FIG. 4, a CPU 6 rewrites the value of fill-in function assigning pad number data FILREG to i by a loop of SP4–SP5–SP11–SP12–SP14, thereby assigning a fill-in function to an ith pad PAD(i). The flow then advances to step SP100, and the CPU 6 writes individual touch data VOLREG(i) of the ith pad PAD(i) in a fill-in volume data register REG11 of a register 25 (FIG. 3) as fill-in volume data FILVOLREG. Thereafter, the flow returns to the main routine through steps SP8 and SP2.

When a performer turns off a pad assigning switch PADA after the fill-in function assigned pad number data FILREG and the fill-in volume data FILVOLREG are set as described above, the CPU 6 executes a loop of steps SP4–SP31–SP32–SP33 and then executes processing in step SP34.

The processing in step SP34Y replaces processing in step SP34 shown in FIG. 4. That is, rhythm volume data RHYVOL2 is temporarily stored in rhythm volume data temporary saving data RHYVOL1, and the fill-in volume data FILVOLREG set in step SP100 is set in the rhythm volume data RHYVOL2. Thereafter, the rhythm volume data RHYVOL2 is supplied to a rhythm tone signal generator (TG2) 29.

According to the operations shown in FIG. 14, when the fill-in function is assigned to the ith pad PAD(i), individual pad touch data VOLREG(i) is almost simultaneously registered as the fill-in volume data FILVOLREG in the fill-in volume data register REG11. As a result, a rhythm tone can be generated in a volume precisely corresponding to the rhythm volume data.

[5] Modifications (1) In FIGS. 4, 13 and 14, after the start subroutine is executed in step SP42, the tone of the sound source corresponding to the pad assigned sound source number data TONE(i) is generated, and then the flow returns from step SP2 to the main routine. The flow, however, may directly return from SP42 to the main routine without executing the tone generating processing in step SP8.

(2) In each of the embodiments shown in FIGS. 11 to 13, each time the pad assign switch PADA is turned on once and the pad PAD(i) is struck, another rhythm sound source group is selected. A method of selecting a rhythm sound source group, however, is not limited to that of the above embodiment. For example, another sound source group may be selected only when the pad assign switch PADA is turned on twice or more within a predetermined time period (e.g., one second).

In this case, an arrangement can be made such that when the pad assign switch PADA is turned on once, the same rhythm sound source group as the previously selected one is selected again, and when the pad assign switch PADA is turned on and the pad PAD(i) is struck in this state, a rhythm sound source in the selected rhythm sound source group is selected.

(3) In each of the above embodiments, a rhythm sound source group is designated on the basis of the pad assigned sound source number data TONE(i). The same effect can be obtained, however, by designating a bank number of the tone-color ROM constituting the rhythm sound source group or forming and designating a tone-color ROM pack for each rhythm sound source group.

(4) In each of the above embodiments, the start function, the fill-in function and the rhythm sound source selecting switching function are assigned to each pad of the electronic percussion unit having pads as performance operating members. Objects to be assigned, however, are not limited to these pads. For example, the present invention can be widely applied to members such as keys on the keyboard 2 originally having a function as a performance operating member.

(5) In each of the above embodiments, the start function, the fill-in function, and the rhythm sound source selecting switching function are assigned as functions to be assigned to performance operating members. If necessary, however, a variety of other functions may be designated.

(6) In each of the above embodiments, the fill-in pattern in addition to the normal pattern is inserted as a rhythm pattern. A rhythm pattern to be inserted, however, is not limited to those of the above embodiments. For example, break pattern, an end pattern, and a variation may be applied as rhythm patterns.

(7) In each of the above embodiments, the four pads PAD1 to PAD4 are used as performance operating members to which the switching function is assigned in the rhythm performance. The number of performance operating members, however, is not limited to four but may be one or more.

(8) In each of the above embodiments, the fill-in information and the start information can be inputted as input information representing a rhythm performance state by the performance operating members. The rhythm performance state information to be inputted by the performance operating members, however, is not limited to those of the above embodiments but may be variation, introduction, and ending switching information and the like.

(9) In each of the above embodiments, while rhythm performance is being executed, the fill-in information can be assigned to a performance operating member. The same can be obtained, however, by inhibiting the assigning operation when the rhythm performance is executed (i.e., when RUN="1") and executing this operation only when the rhythm performance is stopped.

In each of the above embodiments, a sound source may be selected by selecting one of a plurality of selection switches or in accordance with the number of depression times of a single switch. A selecting means, however, is not limited to the selection switches in the above embodiments. For example, a vocoder (which can be triggered by a voice) or the like may be used in combination with selection switches to perform assignment. That is, in each of the above embodiments, an assignment procedure is performed by depressing a selection switch and striking a pad. When the vocoder or the like is used, however, a voice (such as "pee" or "ah") may be made, e.g., six times to obtain an electrical signal based on the voice from the vocoder or the like. In this case, when the number of made voices is twice, three or four times, and five or six times, a bass drum, a hi-hat cymbal, and tom-toms may be assigned, respectively.

Figure 15:
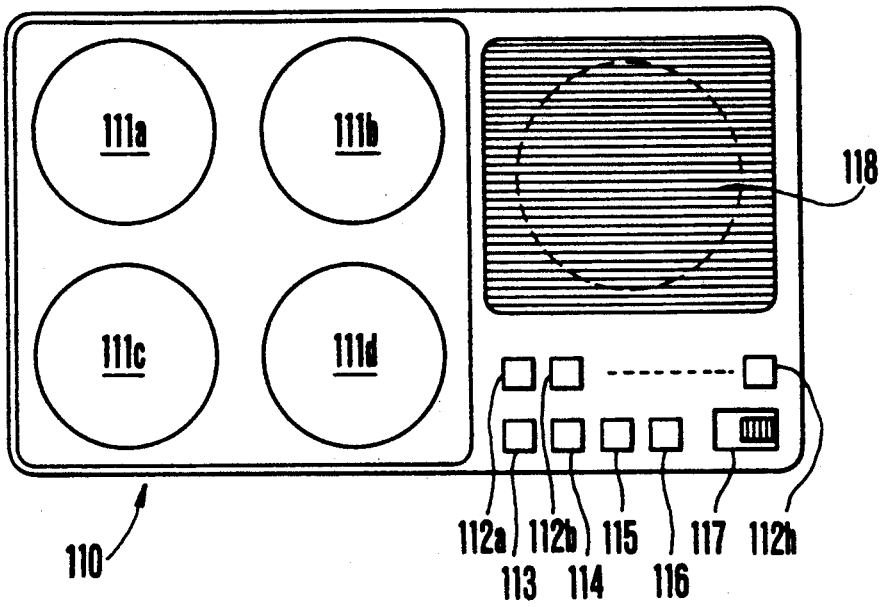
FIG. 15 is a schematic view showing an operation panel of an electronic musical instrument according to a fifth embodiment of the present invention.

FIG. 15 shows a fifth embodiment of the present invention. Referring to FIG. 15, an operation panel 110 of an electronic musical instrument comprises four pad operating members 111*a*, 111*b*, 111*c* and 111*d*, eight registration operating members 112*a*, 112*b*, . . . , 112*h*, a play operating member 113,, a program operating member 114, a musical instrument selecting operating member 115, a tone generation number operating member 116, power source operating member 117 and a loudspeaker 118. Each of the pad operating members 111*a* to 111*b* controls generation of a percussion tone upon depression, and each of the registration operating members 112*a* to 112*h* designates a corresponding one of eight registration memories 123*b*-0, 123*b*-1, . . . , 123*b*-7. The play operating member 113 is used to set the electronic musical instrument in a performance mode. In the performance mode, generation of the percussion tone is controlled in accordance with an operation of each of the pad operating members 111*a* to 111*d*. The program operating member 114 is used to set the electronic musical instrument in a program mode. In the program mode, arbitrary ones of the percussion tones which can be generated by the electronic musical instrument are time-sequentially assigned to the pad operating members 111*a* to 111*d* in accordance with operations of the pad 15 operating members 111*a* to 111*d*, the musical instruments electing operating member 115, and the tone generation number operating member 116. The musical instrument selecting member 115 is used to select/set a musical instrument in the above assigning program mode. The tone generation number operating member 116 is used to set a tone generation number in the above assigning program mode. The power source operating member 117 is used to switch on/off a power source of the electronic musical instrument. The loudspeaker 118 generates a percussion tone.

Figure 16:
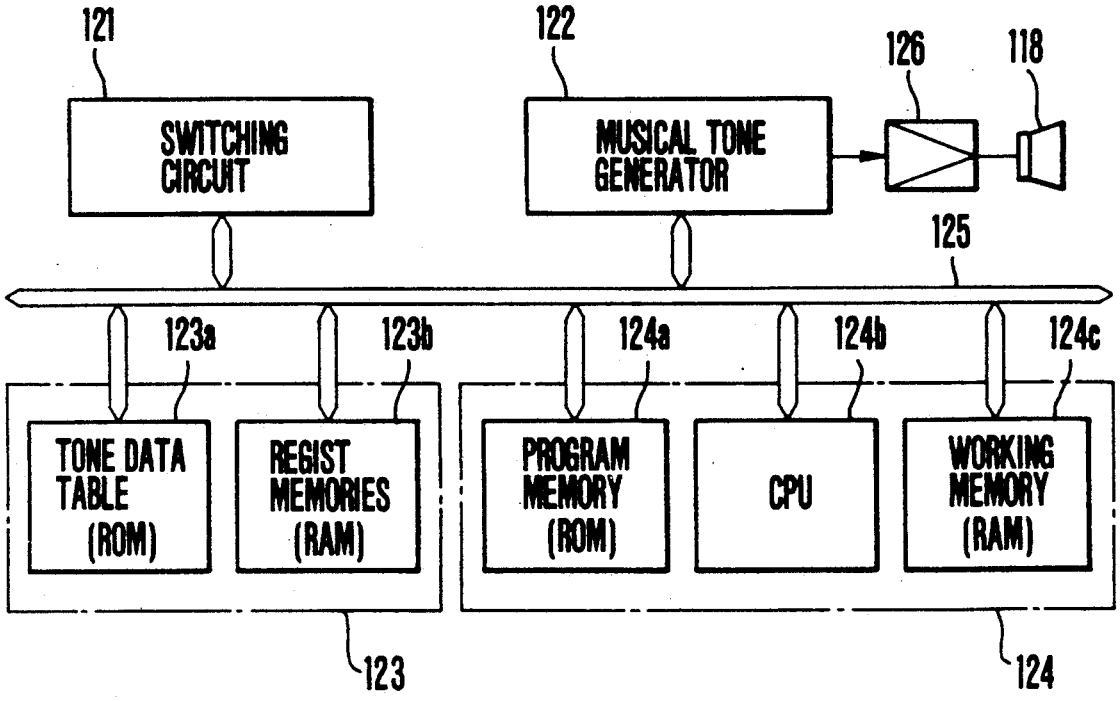
FIG. 16 is a block diagram showing an electronic circuit incorporated in the electronic musical instrument shown in FIG. 15.

Electronic circuits incorporated in this electronic musical instrument will be described below. As shown in FIG. 16, the electronic musical instrument comprises a switching circuit 121, a musical tone signal generator 122, a data memory 123 and a microcomputer 124. These circuits 121 to 124 are connected to a bus 125. The switching circuit 121 comprises pad switches, registration switches, a play switch, a program switch, a musical instrument selecting switch, a tone generation number switch and a power source switch corresponding to the operating members 111*a* to 111*d*, 112*a* to 112*h*, and 113 to 117, respectively. The musical tone signal generator 122 forms and outputs a variety of percussion tone signals. The type of percussion tone signal is controlled in accordance with musical instrument data representing a percussion name. An output from the musical tone signal generator 122 is supplied to the loudspeaker 118 through an amplifier 126.

Figure 18:
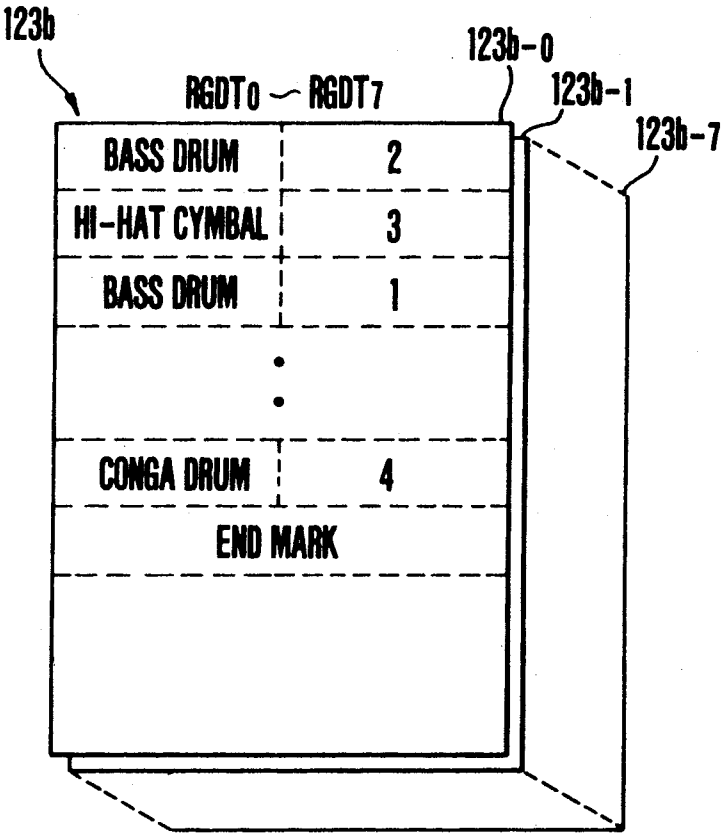
FIG. 18 is a schematic view showing a format of data stored in a registration memory shown in FIG. 16.
Figure 17:
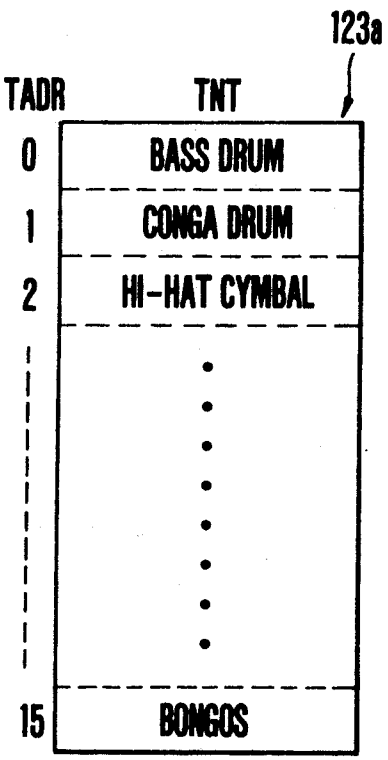
FIG. 17 is a schematic view showing a format of data stored in a tone data table shown in FIG. 16.

The data memory 123 comprises a tone data table 123*a* and registration memories 123*b* connected to the bus 125, respectively. The tone data table 123*a* is constituted by a ROM and stores musical instrument name data representing musical instrument names as table tone data TNT(TADR) at memory positions to be designated by table addresses TADR (e.g., 0 to 15) as shown in FIG. 17. The registration memories 123*b* are constituted by a RAM and comprise eight registration memories 123*b*-0, 123*b*-1, . . . , 123*b*-7 corresponding to the registration operating members 112*a* to 112*h*, respectively, as shown in FIG. 18. Referring to FIG. 18, the registration memories 123*b*-0 to 123*b*-7 store registration data $RGDT_0$ to $RGDT_7$ each including a series of tone generation control data each consisting of the above musical instrument name data (upper bit) and tone generation number data (lower bit) representing a continuous tone generation number of a percussion tone corresponding to the musical instrument name data and an end mark arranged at the end of the data.

The microcomputer 124 comprises a program memory 124*a*, a CPU 124*b* and a working memory 124*c* which are connected to the bus 125. The program memory 124*a* is constituted by a ROM and stores a program corresponding to flow charts shown in FIGS. 21 to 23. The CPU 124*b* executes the program. The working memory 124*c* is constituted by a RAM and has pad registers 124*c*-10 to 124*c*-13 corresponding to the pad operating members 111*a* to 111*d* and other registers 124*c*-20 to 124*c*-23. Pad data $PDDT_0$(PADR) to $PDDT_3$(PADR) each including a series of tone generation control data each consisting of musical instrument name data (upper bit) and tone generation number data (lower bit) and an end mark arranged at the end of the data are stored in memory positions designated by pad addresses PADR of the pad registers 124*c*-10 to 124*c*-13, respectively. Other registers 124*c*-20 to 124*c*-23 store the pad addresses $PADR_0$ to $PADR_3$, tone data $TNTD_0$ to $TDT_3$, number data $CTDT_0$ to $CTDT_3$ and count data $CTVL_0$ to $CTVL_3$, respectively. The tone data $TNDT_0$ to $TNDT_3$ are musical instrument name data according to percussion tones generated upon operations of the pad operating members 111*a* to 111*d*, respectively. Each of the number data $CTDT_0$ to $CTDT_3$ is tone generation number data representing a continuous number of times by which a corresponding one of the percussion tones is to be generated. Each of the count data $CTVL_0$ to $CTVL_3$ is a count representing the number of times by which the corresponding percussion tone is generated.

An operation of the electronic musical instrument having the above arrangement will be described below with reference to the flow charts shown in FIGS. 21 to 23. When a power source switch is closed upon operation of the power source operating member 117, the CPU 124*b* starts execution of a main program from step 130 in FIG. 21. In step 131, the CPU 124*b* transfers all the data in the registration memory 123*b*-0 to the pad registers 124*c*-10 to 124*c*-13, thereby initializing all the pad data $PDDT_0$ to $PDDT_3$ to the first registration data $RGDT_0$. In step 132, the CPU 124*b* initializes all of the pad addresses $PADR_0$ to $PADR_3$, the tone data $TNDT_0$ to $TNDT_3$, the number data $CTDT_0$ to $CTDT_3$, and the count data $CTVL_0$ to $CTVL_3$. In this case, all of the pad addresses $PADR_0$ to $PADR_3$ and the count data $CTVL_0$ to $CTVL_3$ are set to be "0"s. Each of the tone data $TNDT_0$ to $TNDT_3$ and each of the number data $CTDT_0$ to $CTDT_3$ are set to be musical instrument name data at the upper bit and tone generation number data at the lower bit of the pad data $PDDT_0$(0) designated by the pad address $PADR_0$ of "0".

After initialization in steps 131 and 132, a play routine and a program routine are executed upon operations of the play operating member 113 and the program operating member 114 in steps 133 and 134, respectively.

The play routine will be described first below. When the play routine is started in step 140 in FIG. 22, the CPU 124*b* checks in step 141 whether an ON event is present at the program switch. If the program operating member 114 is not operated and therefore no ON event is present, NO (NO) is determined in step 141. The CPU 124*b* then checks in step 142 whether an ON event is present at the pad switch. If neither of the pad operating members 111*a* to 111*d* are operated, NO, i.e., the absence of an ON event is determined in step 142. In this manner, loop processing of steps 141 and 142 is continuously executed.

In this loop processing, if one of the pad operating members 111*a* to 111*d* is operated, YES (YES) is determined in step 142, and the flow advances to step 143. In step 143, pad number data PNO is set to be a value (0 to 3) representing the operated one of the pad operating members 111*a* to 111*d*. After the pad number data PNO is set, the CPU 124*b* checks in step 144 whether the register switch is turned on. If neither of the registration operating members 112*a* to 112*h* are operated when one of the pad operating members 111*a* to 111*d* is operated, NO representing that none of the registration switches are turned on is determined in step 144, and the flow advances to step 145.

In step 145, tone data $TNTD_{PNO}$ designated by the pad number data PNO is outputted to the musical tone signal generator 122. The musical tone signal generator 122 forms a musical tone signal related to a percussion represented by the data $TNDT_{PNO}$ and supplies the musical tone signal to the loudspeaker 118 through the amplifier 126, and the loudspeaker 118 generates a musical tone corresponding to the musical tone signal. In this manner, when any of the pad operating members 111*a* to 111*d* is operated, the musical tone of the percussion assigned to the operated pad operating member and corresponding to the tone data $TNDT_{PNO}$ is generated accordingly. After step 145, count data $CRVL_{PNO}$ designated by the pad number data PNO is incremented by "1" in step 146. In step 147, the data $CTVL_{PNO}$ is compared with number data $CTDT_{PNO}$ also designated by the pad number data PNO. If the data $CTVL_{PNO}$ and $CTDT_{PNO}$ are not equal to each other, NO is determined in step 147, and the flow returns to the loop processing in steps 141 and 142.

In the loop processing in steps 141 and 142, if one of the pad operating members 111*a* to 111*d* is operated again while neither of the registration operating members 112a to 112h are operated, YES and NO are determined in steps 142 and 144, respectively, and a musical tone of a percussion assigned to the operated pad operating member is generated by the processing in step 145. At the same time, the count data $CTVL_{PNO}$ is further incremented by "1" in step 146, and the count data $CTVL_{PNO}$ is compared with the number data $CTDT_{PNO}$ in step 147. As a result of this comparison, if the data $CTVL_{PNO}$ and $CTDT_{PNO}$ are not yet equal to each other, NO is determined in step 147, and the flow returns to the loop processing in steps 141 and 142. When the percussion tone corresponding to the tone data $TNTD_{PNO}$ is generated the number of times represented by the number data $CTDT_{PNO}$ and the count data $CTVL_{PNO}$ is incremented by the processing in step 46 to be finally equal to the number data $CTDT_{PNO}$, YES is determined in step 147, and the flow advances to steps 148 to 150.

In processing executed in steps 148 to 150, the tone data $TNTD_{PNO}$ and the number data $CTDT_{PNO}$ designated by the pad number data PNO (corresponding to one of the pad operating members 111a to 111d which is previously operated) are updated for generating a tone of the next percussion. In step 148, pad address $PADR_{PNO}$ designated by the pad number data PNO is incremented by "1". in step 149, pad data $PDDT_{PNO}(PADR_{PNO})$ stored at an address designated by the incremented pad address $PADR_{PNO}$ in one of the pad registers 124c-10 to 124c-13 designated by the pad number data PNO is read out. At the same time, an upper bit of the readout pad data $PDDT_{PNO}(PADR_{PNO})$ is set as new tone data $TNTD_{PNO}$, and its lower bit is set as new number data $CTDT_{PNO}$. In step 150, in order to count a tone generation number of percussion tones corresponding to the tone data $TNTD_{PNO}$, count data $CTVL_{PNO}$ designated by the pad number data PNO is initialized to be "0".

After the processing in step 150, the CPU 124b checks in step 151 whether the readout pad data $PDDT_{PNO}(PADR_{PNO})$ is an end mark. If the pad data $PDDT_{PNO}(PADR_{PNO})$ is not an end mark, NO is determined in step 151. The flow therefore returns to step 141, and the processing from steps 141 to 151 is executed again. If the pad data $PDDT_{PNO}(PADR_{PNO})$ becomes an end mark as a result of increment of the pad address $PADR_{PNO}$ executed in step 148, YES is determined in step 151, and the pad address $PADR_{PNO}$, the tone data $TNTD_{PNO}$ and the number data $CTDT_{PNO}$ are initialized in step 152. In this initialization, the pad address $PADR_{PNO}$ is set to be "0", and the tone data $TNTD_{PNO}$ and the number data $_{CTDTPNO}$ are set to be percussion name data corresponding to an upper bit of pad data $PDDT_{PNO}(0)$ stored at address "0" in one of the pad registers 124c-10 to 124c-13 designated by the pad number data PNO and tone generation number data corresponding to a lower bit of the data $PDDT_{PNO}(0)$, respectively.

After initialization, the flow returns to step 141, and the loop processing consisting of steps 141 to 152 is continuously executed. In this manner, the musical instrument data and the tone generation number data stored in the pad registers 124c-10 to 124c-13 sequentially read out as the tone data $TNTD_{PNO}$ and the number data $CTDT_{PNO}$ upon operations of the pad operating members 111a to 111d, respectively, and generation of the percussion tone signals are controlled in accordance with the respective data $TNTD_{PNO}$ and $CTDT_{PNO}$. As a result, by only sequentially operating the four pad operating members 111a to 111d, a variety of percussion tones can be generated by desired numbers of times. In this embodiment, identical data are stored in the pad registers 124c-10 to 124c-13 by the processing in step 132 (FIG. 21). These data, however, can be arbitrarily changed by registration processing and assigning program processing to be described later.

The registration processing will be described below. In the loop processing consisting of steps 141 to 152, if one of the pad operating members 111a to 111d is operated while one of the registration operating members 112a to 112h is operated, YESES are determined in step 142 and 144 accordingly. As a result, the pad number data PNO is set to be a value representing the operated pad operating member by the processing in step 143, and the flow advances to step 153. In step 153, registration number data RNO is set to be a value (0 to 7) representing the operated registration operating member. After the processing in step 153, all the registration data $RGDT_{RNO}$ stored in registration memory 123b-RNO designated by the registration number data RNO are transferred to one of the pad registers 124c-10 to 124c-13 designated by the pad number data PNO, and pad data $PDDT_{PNO}$ in the designated register is updated to the registration data $RGDT_{RNO}$. In this manner, with simple operations of the pad operating members 111a to 111d and the registration operating members 112a to 112h, the pad data $PDDT_0$ to $PDDT_3$ are set to the desired registration data $RGDT_0$ to $RGDT_7$. Therefore, the pad data $PDDT_0$ to $PDDT_3$ can be changed during performance of the electronic musical instrument.

After the processing in step 154, the pad address $PADR_{PNO}$, the tone data $TNTD_{PNO}$, the number data $CTDT_{PNO}$, and the count data $TNTD_{PNO}$ are initialized in step 155. In this initialization, similar to the processing in steps 152 and 150, the pad addresses $PADR_{PNO}$ and the count data $CTVL_{PNO}$ are set to be "0"s, and the tone data $TNTD_{PNO}$ and the number data $_{CTDTPNO}$ are set to be percussion name data corresponding to an upper bit of pad $PDDT_{PNO}(0)$ designated by the pad number data PNO and tone generation number data corresponding to its lower bit. After this initialization, the flow returns to step 141, and the loop processing from steps 141 to 152 is executed to control generation of the percussion tones.

The assigning program processing of the electronic musical instrument will be described below. In order to execute the assigning program processing, a performer operates the program operating member 114. When the program operating member 114 is operated, the CPU 124b which is currently executing the loop processing consisting of steps 141 to 152 determines in step 141 YES representing that an ON event is present on the program switch. The flow therefore advances to the program routine in step 134 (FIG. 21) by processing in step 156, and processing of this routine is executed. In the program routine, the pad data $PDDT_0$ to $PDDT_3$ in the pad registers 124c-10 to 124c-13 and the registration data $RGDT_0$ to $RGDT_7$ in the registration memories 123b-0 to 123b-7 are changed in accordance with operations of the pad operating members 111a to 111d, the registration operating members 112a to 112h, the musical instrument selecting operating member 15, and the tone generation number operating member 16. Before an explanation of this changing operation, an operation sequence of a performer will be described first.

1 First, the performer operates one of the pad operating members 111*a* to 111*d* while he or she operates the musical instrument selecting operating member 115, thereby generating a percussion tone. The performer repeatedly operates the above one of the pad operating members 111*a* to 111*d* until the generated percussion tone becomes a desired tone.

2 The performer then operates the tone generation number operating member 116 and repeatedly operates the above one of the pad operating members 111*a* to 111*d* a desired number of times by which the above desired percussion tone is continuously generated.

3 The performer repeatedly executes the operations of 1 and 2.

4 After the performer repeatedly executes the operation of 3, he or she operates the registration operating members 112*a* to 112*h*.

Figure 23:
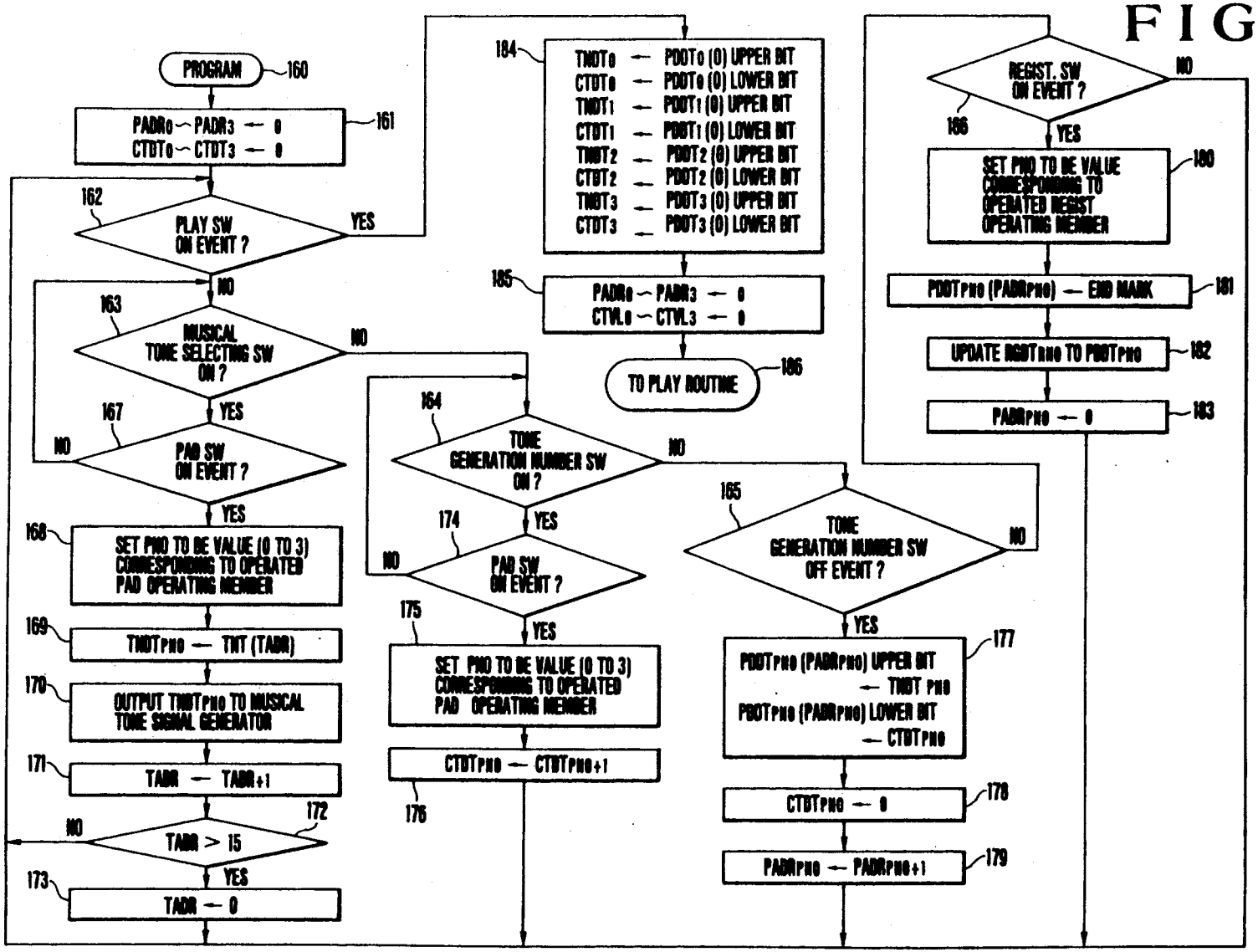

The above program routine is shown in detail in FIG. 23. Referring to FIG. 23, the program routine is started in step 160, and all of the pad addresses $PADR_0$ to $PADR_3$ and the number data $CTDT_0$ to $CTDT_3$ are initialized to be "0"s in step 161. After this initialization, the CPU 124*b* checks in step 162 whether an ON event is present on the play switch. If the play operating member 113 is not operated and therefore no ON event is present, NO is determined in step 162. The CPU 124*b* therefore checks in steps 163 to 166 whether the musical instrument selecting switch is turned on, the tone generation number switch is turned on, an OFF event is present on the tone generation number switch, and an ON event is present on the registration switch, respectively. If neither of the musical selecting operating member 115, the tone generation number operating member 16 and the registration operating members 112*a* to 112*h* are operated, NOES are determined in all the steps 163 to 166, and the CPU 124*b* continuously executes loop processing consisting of steps 162 to 166.

In this loop processing, if one of the pad operating members 111*a* to 111*d* is operated while the musical selecting operating member 115 is operated as in the operation of 1 , YES representing that the musical selecting switch is turned on is determined in step 163. At the same time, YES representing that the ON event is present on the pad switch is determined in step 167. The flow therefore advances to step 168. If neither of the pad operating members 111*a* to 111*d* are operated while the musical instrument selecting operating member 115 is operated, NO is determined in step 167. Therefore, the loop processing from steps 163 and 167 is continuously executed to wait for an operation of any of the pad operating members 111*a* to 111*d*.

Processing from step 168 will be described below. In step 168, pad number data PNO is set to be a value (0 to 3) representing the operated one of the pad operating members 111*a* to 111*d*. In step 169, tone data $TNTD_{PNO}$ designated by the pad number data PNO is set to table tone data TNT(TADR) stored in a memory position designated by table address TADR of the tone data table 123*a*. In step 170, the tone data $TNTD_{PNO}$ is outputted to the musical tone signal generator 122. In this manner, a musical tone of a percussion represented by the tone data $TNTD_{PNO}$ is generated. After the processing in step 170, the table address TADR is incremented by "1" in step 171, and the CPU 124*a* checks in step 172 whether the incremented table address TADR exceeds "15" (final address of the tone data table 123*a*).

If the table address TADR exceeds "15", YES is determined in step 172. The table address TADR is therefore initialized to be "0" in step 173, the flow returns to step 162. If the table address TADR does not exceed "15", NO is determined in step 172, and the flow returns to step 162. In this manner, since the flow returns to step 162, steps 162, 163 and 167 to 173 are executed when any of the pad operating members 111*a* to 111*d* is operated while the musical selecting operating member 115 is operated, thereby controlling generation of a percussion tone. In this case, however, since the table address TADR is sequentially, repeatedly incremented by the processing in steps 171 and 173, the percussion tones represented by the table tone data TNT stored in the tone data table 123*a* are sequentially generated. As a result, by operating any of the pad operating members 111*a* to 111*d* and the musical instrument selecting operating member 115, musical instrument data representing a desired percussion is set and stored as the tone data $TNTD_{PNO}$.

In the loop processing consisting of steps 162 to 166, if one of the pad operating members 111*a* to 111*d* is operated while the tone generation number operating member 116 is operated as in the operation of 2 , YES representing that the tone generation number switch is turned on is determined in step 164, and YES representing that an ON event is present on the pad switch is determined in step 174. The flow therefore advances to step 175. If neither of the pad operating members 111*a* to 111*d* are operated while the tone generation number operating member 116 is operated, NO is determined in step 174, and the loop processing of steps 164 and 174 is continuously executed to wait for an operations of any of the pad operating members 111*a* to 111*d*.

Processing from step 175 will be described below. In step 175, pad number data PNO is set to be a value (0 to 3) representing the operated one of the pad operating members 111*a* to 111*d*. In step 176, number data $CTDT_{PNO}$ designated by the pad number data PNO is incremented by "1". When the operated one of the pad operating members 111*a* to 111*d* is operated again while the tone generation number operating member 116 is kept operated, the number data $CTDT_{PNO}$ is sequentially incremented by "1" by the processing in steps 164 and 174 to 176. As a result, by operating any of the pad operating members 111*a* to 111*d* and the tone generation number operating member 116, a continuous tone generation number of a desired percussion is set and stored as the number data $CTDT_{PNO}$.

Figure 19:
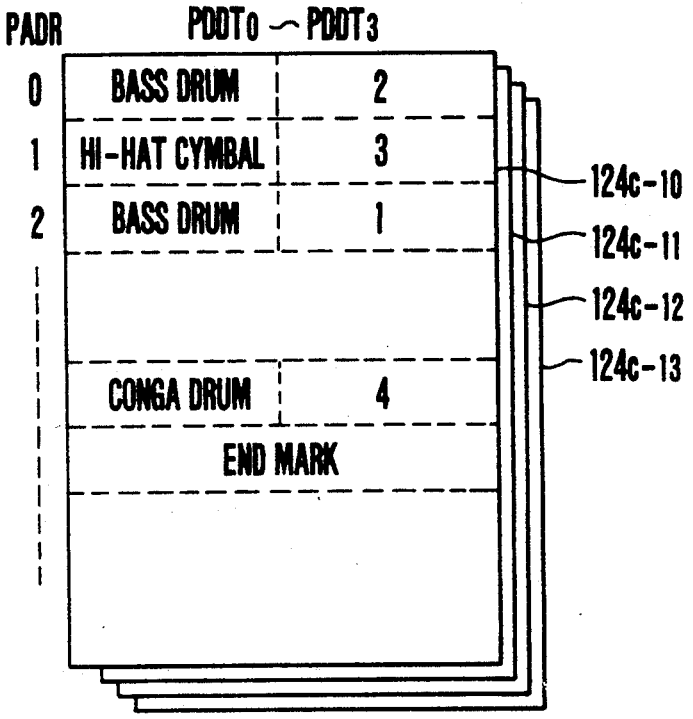
FIGS. 19 and 20 are schematic views showing data stored in a working memory shown in FIG. 16.
Figure 20:
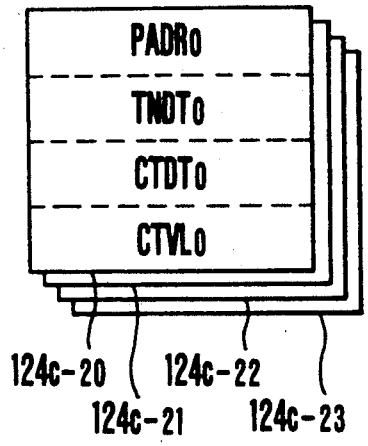

In this state, if the operation of the tone generation number operating member 116 is released, the CPU 124*b* determines NO in step 164 and YES representing that an OFF event is present on the tone generation number switch in step 165, and the flow advances to step 177. In step 177, the tone data $TNDT_{PNO}$ and the number data $CTDT_{PNO}$ set in the previous processing are stored in addresses designated by pad address $PADR_{PNO}$ in each of the pad registers 124*c*-10 to 124*c*-13 designated by the pad number data PNO (representing the operated one of the pad operating members 111*a* to 111*d*). The tone data $TNTD_{PNO}$ and the number data $CTDT_{PNO}$ are stored as musical instrument data and tone generation number data at an upper bit and a lower bit at the address, respectively. As a result, the same pad data $PDDT_{PNO}(PADR_{PNO})$ in a format as shown in FIG. 19 is assigned and stored in the pad registers 124*c*-10 to 124*c*-13.

After the processing in step 177, the number data $CTDT_{PNO}$ is initialized to be "0" in step 178. In step 179, the pad address $PADR_{PNO}$ utilized in storage of the pad data $PDDT_{PNO}(PADR_{PNO})$ is incremented by "1", and the flow returns to step 162. As in the operation of 3 , the pad operating members 111*a* to 111*d*, the musical instrument selecting operating member 115 and the tone generation number operating member 116 are repeatedly operated to set new tone data $TNDT_{PNO}$ and number data $CTDT_{PNO}$ in steps 163, 164 and 167 to 176, and the operation of the tone generation number operating member 116 is released. As a result, pad data $PDDT_{PNO}(PADR_{PNO})$ corresponding to the pad address $PADR_{PNO}$ incremented by "1" in step 179 is assigned and stored.

After the pad data $PDDT_{PNO}(PADR_{PNO})$ are sequentially assigned and stored in the pad registers 124*c*-10 to 124*c*-13 as described above, if any of the registration operating members 112*a* to 112*h*, the CPU 124*b* which is currently executing the loop processing in steps 162 to 166 determines in step 166 YES representing that an ON event is present on the registration switch, and the flow advances to step 180. In step 180, registration number data RNO is set to be a value (0 to 7) representing the operated one of the registration operating members 12*a* to 12*h*. In step 181, an end mark is set and stored as pad data $PDDT_{PNO}(PADR_{PNO})$ corresponding to the pad address $PADR_{PNO}$ as shown in FIG. 19. After the processing in step 181, registration data $RGDT_{RNO}$ stored in a registration memory 123*b*-RNO designated by the registration number data RNO is updated to the programmed pad data $PDDT_{PNO}$ in step 182. As a result, by the processing in steps 181 and 182, programming of a pair of the pad data $PDDT_{PNO}$ designated by one of the pad operating members 111*a* to 111*d* is completed, and the programmed pad data $PDDT_{PNO}$ is stored in the registration memory 123*b*-RNO designated by one of the registration operating members 112*a* to 112*h*. After the processing in step 182, the pad address $PADR_{PNO}$ for designating memory addresses of the pad registers 124*c*-10 to 124*c*-13 for storing the pad data $PDDT_{PNO}$ is initialized to be "0", and the flow returns to step 162.

After a variety of the pad data $PDDT_0$ to $PDDT_3$ are programmed and stored in the registration memories 123*b*-0 to 123*b*-7, if the play operating member 13 is operated, the CPU 124*b* which is currently executing the loop processing in steps 162 to 166 determines YES in step 162, and the flow advances to steps 184 and 185. In step 184, the tone data $TNDT_0$ to $TNDT_3$ and the number data $CTDT_0$ to $CTDT_3$ are initialized to musical instrument name data and tone generation number data corresponding to the pad data $PDDT_0(0)$ to $PDDT_3(0)$ stored in an address "0" of each of the pad registers 124*c*-10 to 124*c*-13. In step 185, the pad addresses $PADR_0$ to $PADR_3$ and the count data $CTVL_0$ to $CTVL_3$ are initialized to be "0"s. With such initialization, generation of percussion tones corresponding to operations of the pad operating members 111*a* to 111*d* in the play mode of the electronic musical instrument is prepared. Thereafter, the CPU 124*b* executes processing in step 186, thereby advancing the flow to the play routine in step 133 (FIG. 21). In this manner, according to the electronic musical instrument of the present invention, the musical instrument name data and the tone generation number data time-sequentially assigned to the pad registers 124*c*-10 to 124*c*-13 and stored in the registration memories 123*b*-0 to 123*b*-7 are utilized to generate tones of a variety of percussions according to operations of the pad operating members 111*a* to 111*d*.

The embodiment having the above arrangement can be modified and carried out as follows.

Figure 21:
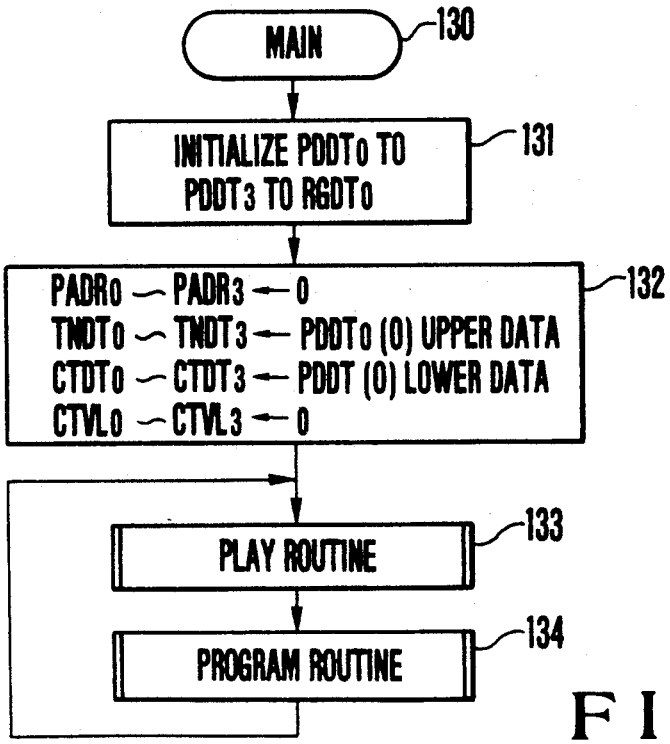
FIGS. 21 to 23 are flow charts for explaining programs executed by a microcomputer shown in FIG. 16.

(1) In the above embodiment, all of the tone data $TNDT_0$ to $TNDT_3$ and the number data $CTDT_0$ to $CTDT_3$ are initialized to the same musical instrument name data and tone generation number data by the processing in steps 131 and 132 (FIG. 21). The tone data $TNDT_0$ to $TNDT_3$ and the number data $CTDT_0$ to $CTDT_3$, however, may be initialized to different musical instrument name data and tone generation number data. In this case, for example, the pad data $PDDT_0$ to $PDDT_3$ may be initialized to the registration data $RGDT_0$ to $RGDT_3$, respectively, in step 131. In addition, in step 132, the tone data $TNDT_0$ to $TNDT_3$ and the number data $CTDT_0$ to $CTDT_3$ may be set to musical instrument name data and tone generation number data constituting the pad data $PDDT_0(0)$ to $PDDT_3(0)$, respectively.

(2) In the above embodiment, no external memory device such as a magnetic tape or a magnetic disk is connected to the electronic musical instrument. An external memory device, however, may be connected to transmit/receive data to/from the registration memories 123*b*-0 to 123*b*-7. In this manner, the programmed pad data $PDDT_0$ to $PDDT_3$ can be stored in a better state. Alternatively, the registration memories 123*b*-0 to 123*b*-7 may be selectively attached to/detached from the electronic musical instrument.

(3) In the musical tone name data and tone generation number data assigning program of the above embodiment, by the processing in steps 166 and 180 to 182 (FIG. 23) executed upon operation of the registration operating members 112*a* to 112*h*, the program completing processing of the pad data $PDDT_0$ to $PDDT_3$ and the storage processing of the registration memories 123*b*-0 to 123*b*-7 are simultaneously executed, but they may be individually executed. In this case, a program end operating member (data enter operating member) is additionally provided on the operation panel 110. When the program end operating member is operated, an end mark is set and stored as the pad data $PDDT_{PNO}(PADR_{PNO})$, thereby executing the program completing processing of the pad data $PDDT_0$ to $PDDT_3$ (corresponding to step 181 in FIG. 23) and only the processing in step 183 of the above embodiment. In addition, upon operation of the registration operating members 112*a* to 112*h* similar to that in the above embodiment, only the processing in steps 180 and 182 similar to the above embodiment may be performed.

(4) In the above embodiment, a pair of the musical instrument name data representing a percussion tone to be generated and a tone generation number data representing a continuous tone generation number of the percussion tone are stored in each of the pad registers 124*c*-10 to 124*c*-13 and the registration memories 123*b*. If the number of data can be increased, however, the number of musical instrument name data equal to the tone generation number may be continuously stored.

(5) In the above embodiment, the musical instrument data and tone generation number data assigning program can be executed to all the pad operating members 111*a* to 111*d*. The assigning program, however, may be executed to only a specific pad operating member.

(6) In the above embodiment, only percussion tones can be generated from the electronic musical instrument. In place of or in addition to the percussion tones, however, tones of musical instruments such as wind and/or stringed instruments or sounds such as barking or mewing.

Figure 22:
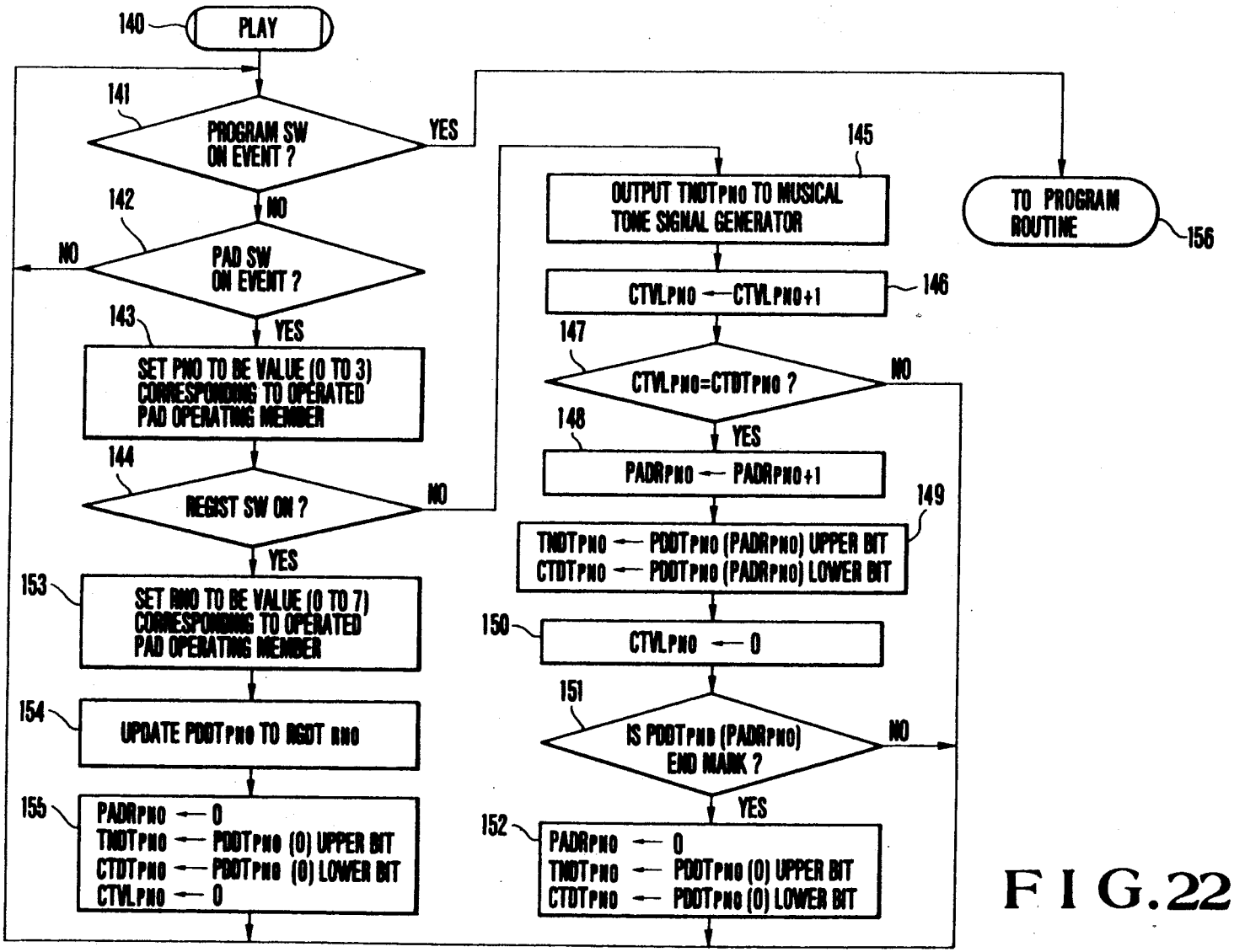
Figure 24:
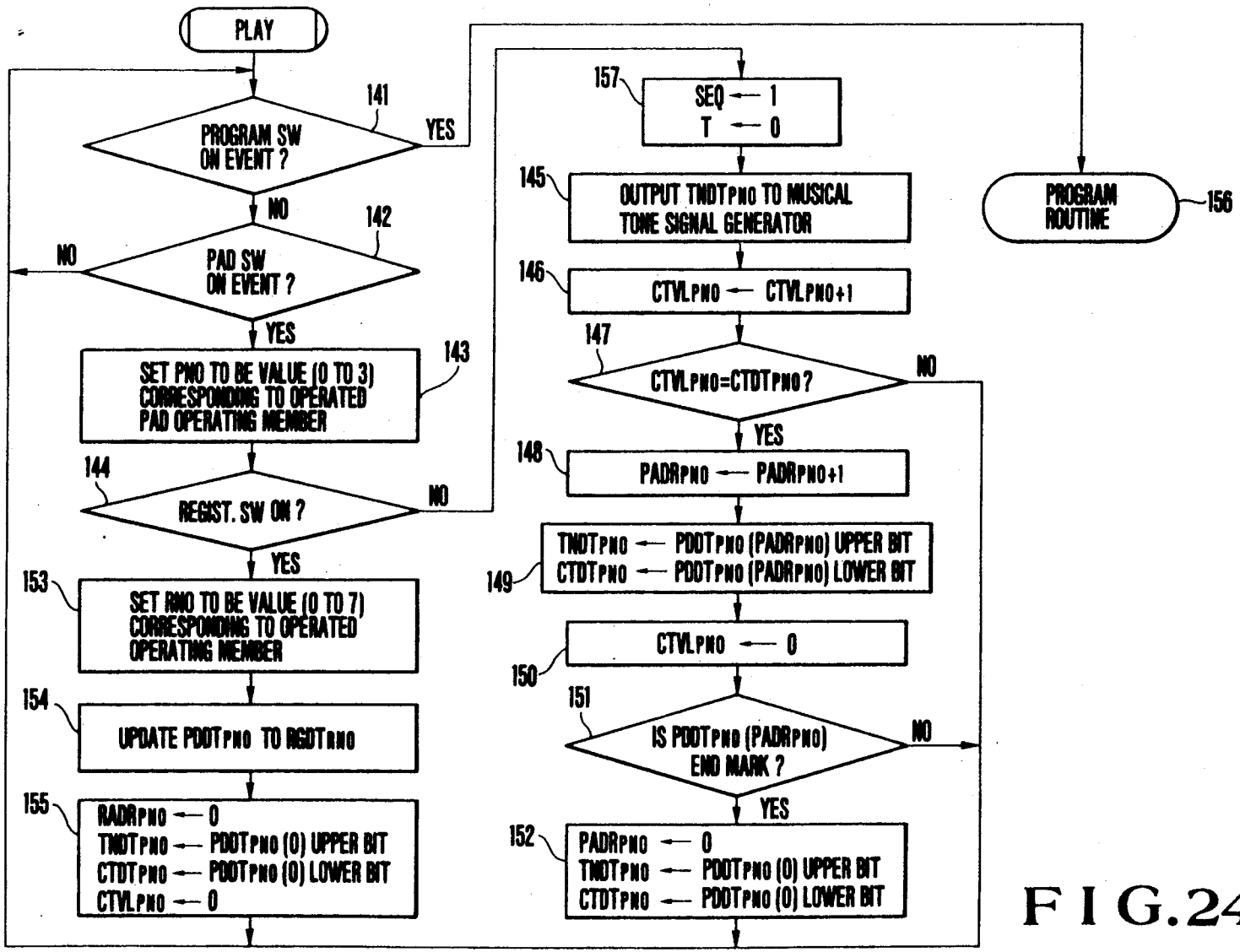
FIGS. 24 and 25 are flow charts for explaining a modification of the present invention.
Figure 25:
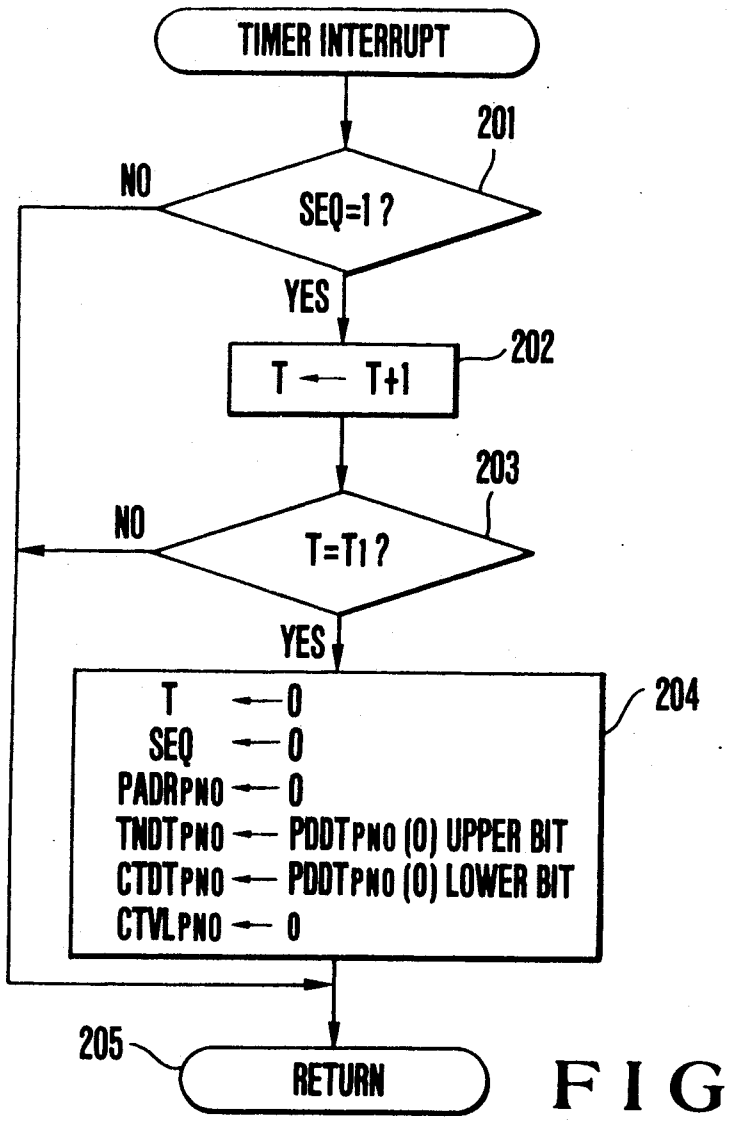

FIG. 24 shows a modification of the embodiment shown in FIG. 22. Referring to FIG. 24, unlike in FIG. 22, when the registration switch is not turned on, the flow indirectly advances to step 145 through step 157. That is, when one of the pad operating members 111*a* to 111*d* is operated and the CPU 124*b* determines in step 142 that an ON event is present on the pad switch, the pad data $TNDT_{PNO}$ the tone data $TNDT_{PNO}$, the number data $CTDT_{PNO}$, and the count data $CTVL_{PNO}$ are initialized to be "0"s if a time interval from a timing of this ON event to a timing at which the next ON event occurs on the pad switch is longer than a set time interval $T_1$. That is, in step 157, a flag "1" set in a register SEQ, "0" is set in a timer T, and a timer interruption routine shown in FIG. 25 is executed. First, in step 201, the CPU 124*b* determines whether the register SEQ is "1". If YES in step 201, the flow advances to step 202. If NO in step 201, the flow directly advances to step 205. If "1" is set in the register SEQ, the content of the counter T is counted up by "1" in step 202. At this time, the counter T counts pulses of, e.g., 1-μsec system clock period or pulses of a 1-msec clock period obtained by frequency-dividing the system clock pulses. In step 203, the CPU 124*b* checks whether the content of the counter T reaches the set time interval $T_1$ (e.g., about 0.5 second). If NO in step 203, the flow advances to step 205. If YES in step 203, the flow advances to step 204, and the following processing is performed. That is, the counter T, the register SEQ, pad address $PADR_{PNO}$ of a pad register, tone data $TNDT_{PNO}$, number data $CTDT_{PNO}$, and count data $CTVL_{PNO}$ are initialized. The flow then advances to step 205.

After step 155 is executed, processing is executed from step 145. In this case, therefore, steps 140 to 144 and 145 to 155 are the same as those in the embodiment described above with reference to FIG. 22.

In the above description, attention is paid to the time interval from the first ON event to the next one of the pad switch. The time interval, however, may be from an nth On event to a (n+1)th ON event. In this manner, the system automatically returns to its initial state if the timing is offset. Therefore, no special operation needs to be executed for performance, resulting in a convenient operation. In this modification, attention is paid to one pad operating member. In this modification, however, since a plurality of pad operating members are used, a plurality of timer interruption intervals may be provided to the respective pad operating members in a one-to-one relation, thereby checking ON event timings of the pad operating members.

Figure 26:
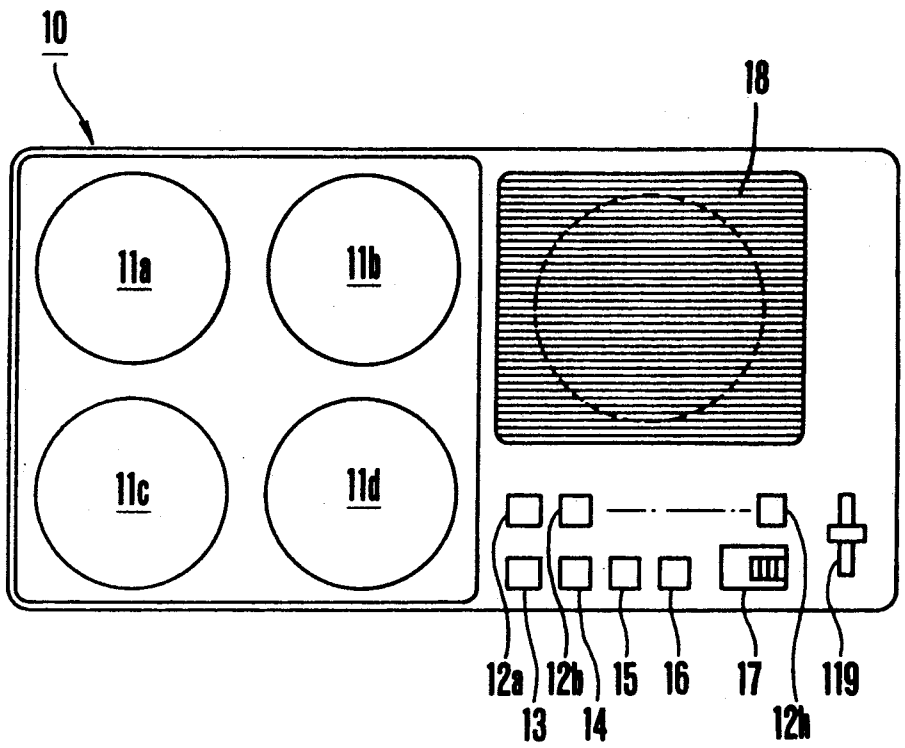
FIG. 26 is a schematic view of an operation panel for explaining another modification of the present invention.
Figure 27:
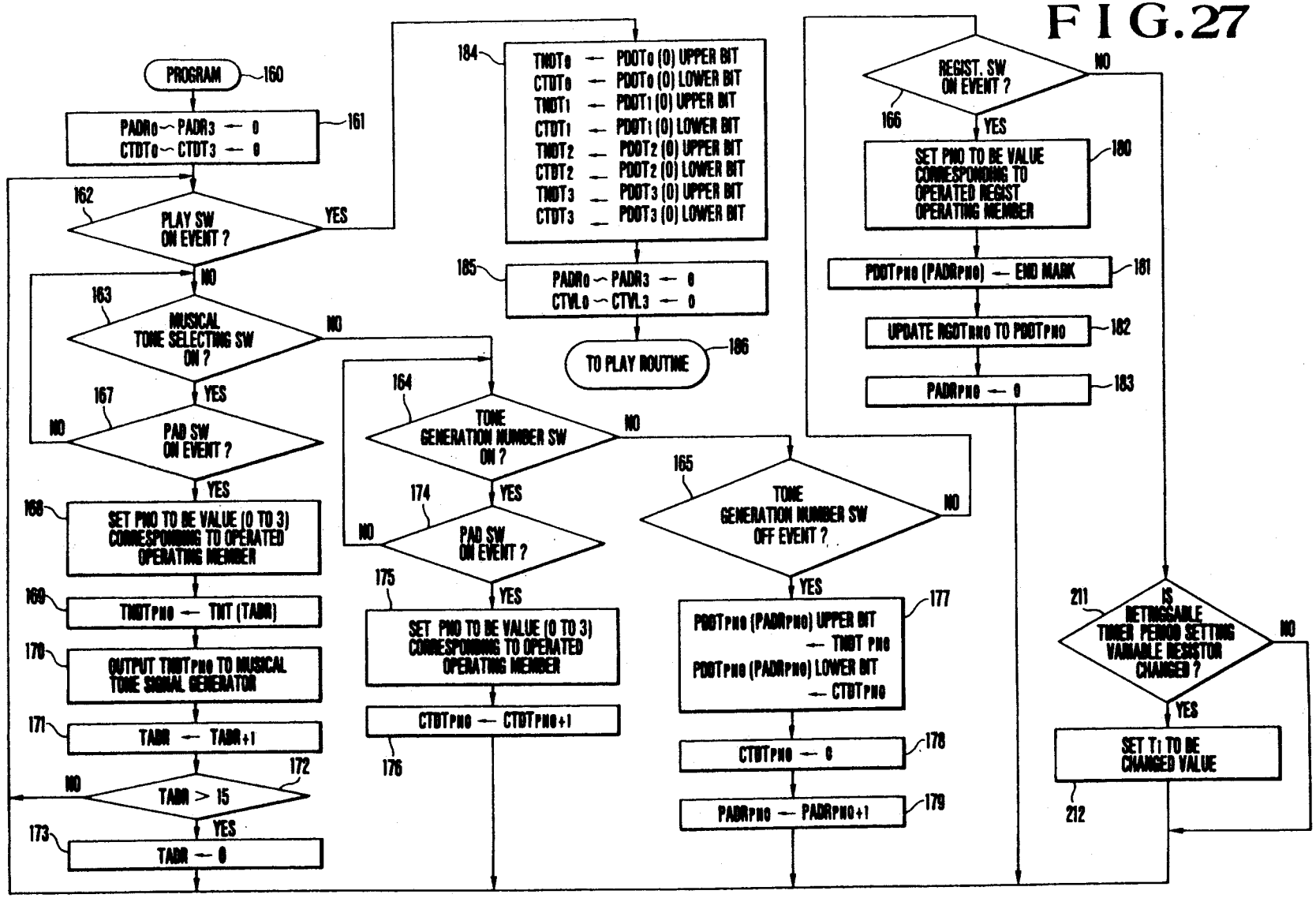
FIG. 27 is a flow chart to be explained in relation to FIG. 26.

FIG. 26 shows a modification of FIG. 15. This modification further comprises a slide type variable resistor 119. The variable resistor 119 is a retriggable timer period setting variable resistor capable of directly outputting, e.g., a digital value. By adjusting the variable resistor 119, the timer interruption interval $T_1$ shown in FIG. 25 can be easily varied. A flow chart corresponding to that in FIG. 23 is shown in FIG. 27. A difference between FIGS. 27 and 23 is that steps 211 and 212 are additionally provided to be executed when no ON event is present on the registration switch in step 166 in FIG. 27. The other steps are the same as those in FIG. 23. That is, in FIG. 27, if no ON event is present on the registration switch in step 166, the flow advances to step 211, and the CPU 124*b* checks whether the retriggable timer period setting variable resistor 119 is operated. If YES in step 211, the flow advances to step 212, and the timer set time interval $T_1$ is reset, and the flow returns to step 162. If NO in step 211, the flow directly returns to step 162.

In the above embodiments, if the number of operation times of the performance operating member is larger than a predetermined value or an operation time interval is longer than a predetermined time interval, the data are initialized. The predetermined value for determining the upper limit of the operation time interval, however, may be changed in accordance with a tempo of a rhythm.

In this manner, the data can be reset at an early timing during a quick-tempo music and at a late timing during a slow-tempo music. That is, the data are reset at a relatively constant rate.

What is claimed is:

1. An electronic musical instrument, comprising:

input means for designating input data, said input means outputting operation data;

a second source unit for generating a plurality of rhythm tones in accordance with said operational data;

determining means for determining a rhythm tone to be assigned to said input means in accordance with a number of input data designation operations, each rhythm tone corresponding to a predetermined number of input data designation operations; and assignment information memory means for storing assigning information representing a rhythm tone assigned to said input means, in accordance with an output of said determining means so that said sound source unit generates, in accordance with said operation data, said rhythm tone which is assigned to said input means.

2. An electronic musical instrument according to claim 1, further comprising control information registering means for registering assignment information in said assignment information memory means in response to an input.

3. An electronic musical instrument according to claim 2, further comprising:

detecting means for detecting an inputting operation touch intensity of said input means; and determining means for determining a rhythm tone to be generated on the basis of the detected inputting operation touch intensity when said control information registering means is not operated.

4. An electronic musical instrument according to claim 2, further comprising:

rhythm performance state information inputting means for designating a rhythm performance state; and selecting means for selecting a first mode for generating a percussion tone and a second mode designated by said rhythm performance state information inputting means in accordance with an inputting operation of said input means;

wherein said control information registering means executes control information registering processing when the second mode is selected.

5. An electronic musical instrument according to claim 2, wherein rhythm tones are divided into a plurality of groups, further comprising designating means for designating one of the rhythm tone groups in accordance with a number of control information registering means inputting operations;

wherein said rhythm tone determining means determines a rhythm tone in a designated rhythm tone group in accordance with a number of input data designation operations.

6. An electronic musical instrument according to claim 5, wherein the rhythm tones are grouped in accordance with corresponding.

7. An electronic musical instrument according to claim 2, wherein said control information registering means comprises a manual switch.

8. An electronic musical instrument accordance to claim 1, further comprising initializing means for initializing the assigning information when the number of input data designation operations exceeds a total number of available rhythm tones.

9. An electronic musical instrument according to claim 1, wherein said input means comprises plural operating members and wherein the assignment information comprises a rhythm tone and data specifying one of said operating members to be assigned said rhythm tone.

10. An electronic musical instrument according to claim 1, further comprising determining means for determining a volume of the rhythm tone assigned to said input means in accordance with the number of input data designation operations.

11. An electronic musical instrument according to claim 5, further comprising supplying means for supplying a present volume as the assignment information when no information for determining the volume of a rhythm tone is given.

12. An electronic musical instrument according to claim 1, further comprising initializing means for executing initialization when a time interval between input data designation operations of said input means is longer than a predetermined period.

13. An electronic musical instrument according to claim 1, wherein said input means comprises a performance operating means.

14. An electrical musical instrument, comprising:

plural operators which output operation information indicating which of said operators is operated;

mode selecting means for selecting one of a programming mode and a play mode, in which when the programming mode is selected, information is written for an operator, and when the play mode is selected, tones are generated in accordance with information previously written for an operation;

first memory means for storing tone color information assignable to said plural operators;

means for designating tone color information to be assigned to an operator from said first memory means;

second memory means for storing tone color information assigned to said operator from said first memory means;

write control means responsive to operation information for, when the programming mode has been selected, writing tone color information output from said first memory means into said second memory means;

read-out control means for, when the play mode has been selected, reading out tone color information from said second memory means; and means for generating tones in accordance with tone color information assigned to an operated operator;

wherein tone color information output from said first memory is defined as tone color information next to be assigned to said operated operator.

15. An electronic musical instrument according to claim 14, wherein said second memory can output tone color information even when tone color information is being written by said write control means.

16. An electronic musical instrument according to claim 14, further comprising group changing means for grouping tone color information and outputting tone color information next to be assigned within a group, the group being changed by said group changing means.

17. An electronic musical instrument according to claim 14, wherein said second memory stores a plurality of tone color information corresponding to said operators, said read control means sequentially reads out the tone color information respectively corresponding to said operators every time each operator is operated, and said write control means sequentially writes at a new position of a memory area corresponding to the operated operator the tone color information which is output from said first memory.

18. An electronic musical instrument according to claim 17, further comprising a third memory for reading out the tone color information from said second memory and storing a number of times said read-out control means directs read access of current tone color information from said second memory, and wherein said read-out control means shifts read access to next tone color information when the current tone color information is read out by a predetermined number of times.

19. An electronic musical instrument, comprising:

plural operators which output operation information indicating which of said operators is operated, each of said operators being operable in a manual tone mode and an automatic rhythm mode;

first memory means for storing tone color information each of said plural operators;

means for reading-out tone color information for an operated operator in a manual tone mode from said first memory means;

means for generating a tone in accordance with tone color information of said operated operator in a manual tone mode;

second memory means for storing automatic rhythm controlling information corresponding to each of said plural operators, wherein said automatic rhythm controlling information comprises an automatic rhythm start signal and an automatic rhythm stop signal;

means for writing automatic rhythm controlling information in said second memory means;

means for generating automatic rhythm tones in accordance with automatic rhythm controlling information corresponding to an operated operator in an automatically rhythm mode; and means for controlling automatic rhythm tone generation based on said automatic rhythm controlling information.

20. An electronic musical instrument according to claim 19, wherein said tone color information is programmable.

21. An electronic musical instrument according to claim 19, wherein said automatic rhythm controlling information is information for changing an automatic rhythm pattern into another automatic rhythm pattern.

22. An electronic musical instrument according to claim 19, further comprising determining means for determining, as automatic rhythm controlling information, tone color information to be assigned to an operator in accordance with a number of operator operations, said number of operator operations being equal to a number of times said operator is operated, said tone color information corresponding to a predetermined number of operator operations.

23. An electronic musical instrument according to claim 19, further comprising determining means for determining a volume of the rhythm tone assigned to said operator in accordance with a number of operator operations, said number of operator operations being equal to a number of times said operator is operated.

24. An electronic musical instrument, comprising:

plural operators which output operation information indicating which of said operators is operated, each of said operators being operable in a manual tone mode and an automatic rhythm mode;

first memory means for storing tone color information for each of said plural operators;

means for reading-out tone color information for an operated operator in a manual tone mode from said first memory means;

means for generating tones in accordance with tone color information for said operated operator in a manual tone mode;

means for determining an operation amount for an operated operator, said operation amount being equal to a number of times said operated operator is operated;

second memory means for storing said operation amount for said operated operator;

means for generating automatic rhythm tones in accordance with said operated operator in the automatic rhythm mode; and means for controlling automatic rhythm tone generation based on said operation amount.

25. An electronic musical instrument according to claim 24, wherein at least one of tone volume and tone color information for automatic rhythm tone generation is controlled.

26. An electronic musical instrument, comprising:

plural operators which output operation data indicating which of said operators has been operated;

mode selecting means for selecting a programming mode and a play mode in which when a programming mode is selected, tone data is recorded, and when a play mode is selected, automatic tones are generated in accordance with previously recorded tone data and manual tones are generated in accordance with a manual designation mode;

means for, when the programming mode is selected, designating tone color data;

means for, when the programming mode is selected, designating tone generation number data, said tone generation number data corresponding to a number of times a tone is to be generated in accordance with corresponding designated tone color data;

first memory means for storing plural sets of tone data including tone color data and tone generation number data;

means for writing tone color data and corresponding tone generation number data in said first memory means, a number of sets of tone color data and corresponding tone generation number data being able to be sequentially written;

means for assigning at least one set of tone data stored in said first memory means to a designated operator;

means for generating tones in accordance with assigned tone data when said designated operator is operated;

second memory means for storing tone color data assignable to said plural operators;

means for designating tone color data to be assigned to an operator from said second memory means; and means for generating manual tones in accordance with tone color data from said second memory means for an operated operator in the manual designation mode.

* * * * *